United States Patent [19]

Igarashi et al.

[11] 4,239,371

[45] Dec. 16, 1980

[54] ELECTROPHOTOGRAPHIC COPYING MACHINES

[75] Inventors: Yousuke Igarashi, Tachikawa; Minehiro Sakata, Hachioji; Shuichi Kudo, Tama; Yasuyuki Yokoyama; Masanori Kai, both of Hachioji, all of Japan

[73] Assignee: Iwatsu Electric Co., Ltd., Tokyo, Japan

[21] Appl. No.: 912,553

[22] Filed: Jun. 5, 1978

[30] Foreign Application Priority Data

| | | | |
|---|---|---|---|
| Jul. 29, 1977 | [JP] | Japan | 52-91191 |
| Jul. 29, 1977 | [JP] | Japan | 52-91192 |
| Jul. 29, 1977 | [JP] | Japan | 52-101508 |
| Jul. 29, 1977 | [JP] | Japan | 52-101510 |
| Aug. 15, 1977 | [JP] | Japan | 52-108882 |
| Aug. 15, 1977 | [JP] | Japan | 52-108884 |

[51] Int. Cl.[3] ..... G03G 15/00

[52] U.S. Cl. ..... 355/14 CH; 83/436; 355/3 CH; 355/3 SH; 355/10; 355/13; 355/75

[58] Field of Search ..... 355/13, 3 R, 3 CH, 7, 355/11, 10, 14 R, 14 CH, 3 SH, 75, 76; 83/925 EB, 436, 437

[56] References Cited

U.S. PATENT DOCUMENTS

| | | | |
|---|---|---|---|
| 3,062,110 | 11/1962 | Shepardson et al. | 355/11 |
| 3,416,860 | 12/1968 | Mihojevich et al. | 355/14 X |
| 3,944,356 | 3/1976 | Hayne | 355/14 X |
| 3,957,369 | 5/1976 | Wirth | 355/10 |

*Primary Examiner*—R. L. Moses

*Attorney, Agent, or Firm*—Merchant, Gould, Smith, Edell, Welter & Schmidt

[57] ABSTRACT

Disclosed is an improved electrophotographic copying machine in which a black frame eliminating mechanism and a random cutting assembly adapted to cut a roll of photosensitive paper to a required length are incorporated. The black frame eliminating mechanism comprises an original supporting window, the length of which is longer than that of an original, an original depressing plate having a white surface facing and covering over the supporting window, means for depositing a charge over the length of a portion of a photosensitive paper, which length corresponds to that of the original, and means for exposing the paper placed at a predetermined position to the light from the entire area of the supporting window. The cutting assembly comprises first, second and third feed rollers arranged in this order along a paper feed passage, first means for driving the first and second feed rollers so as to feed the paper at a first synchronous feeding speed and second means for driving the third feed rollers so as to feed the paper at second feeding speed which is lower than the first speed, a one-way clutch adapted to allow the second rollers to feed the paper only in a downstream direction and cutting means adapted to cut the paper portion between the first and second rollers, wherein cutting of the paper is effected at the location between the first and second rollers when the drive of the first and second rollers is stopped, feeding of the paper is stopped at a position at the first rollers or upstream thereof, and slack of the paper portion between the second and third rollers, caused by difference between the first and second feeding speeds, is being changed to a tensioned condition.

30 Claims, 22 Drawing Figures

ELECTROPHOTOGRAPHIC COPYING MACHINES

BACKGROUND OF THE INVENTION

The present invention relates to electrophotographic copying machines, such as electrophotographic duplicators, electrophotographic plate making machines of electro-fax type plate making machines, or the like.

Conventional electrophotographic copying machines involve various problems which should be solved. One of the problems relates to a "black frame", as mentioned in the specification of U.S. Pat. No. 3,901,593. As is well known in the art, when a partial area of a photosensitive paper is exposed to the light of an original or manuscript, a black frame is formed at the remaining area not exposed, that is around the exposed area.

To cope with the above mentioned problem the following methods have been adopted.

A photosensitive paper, the surface of which is smaller than an exposed area, has been used or an exposed area has been designed so as to be larger than the surface of a photosensitive paper, thus preventing the formation of the black frame. Alternatively, eraser light sources have been used for illuminating undesirable images formed on selected marginal areas of the photosensitive paper for the purpose of preventing the formation of the undesirable black frame on the marginal areas. Copying apparatus provided with such eraser light sources are disclosed in U.S. Pat. No. 3,724,940 and U.S. Pat. No. 3,901,593.

In the conventional copying machine of a wet type, a process for squeezing a developing liquid from a developed paper, subsequent to a wet developing process, involves the following problem. In the squeezing process there is generally used a squeezing roller assembly comprising a pair of rollers urged by spring means so as to press the developed paper passing between the rollers. The surplus developing liquid is thus squeezed from the paper so that fixing and drying of the developed paper are promoted. However, such rollers always have the developing liquid adhered on their surfaces. As a result, when the rollers are operated for a long time, solid layers of the developing liquid are fixed on the surfaces of rollers. This causes a reduction in the squeezing efficiency with the result that the quality of the developed image on the paper is reduced. Further, while the copying operation of the machine is stopped, the developing liquid adhered to the squeezing rollers is vaporized with the result that a toner included in the liquid only remains on the surface of the rollers. In such a situation, if the copying operation is resumed, the residual toner is transferred onto the surface of a developed paper. This causes contamination of the developed image surface of the paper. For this reason, it is necessary to wash and clean the rollers so that the adhered toner is removed from the rollers after the rollers are used for a predetermined operation period. For the washing and cleaning, the means for urging the rollers, such a spring, must be released and, then, a roller positioning and holding means must be removed, so that the rollers can be removed from the machine. Such releasing and removing operations are, in general, carried out from the front side and rear sides of the machine housing, respectively. Further, after the washing and cleaning, the cleaned rollers must be mounted in the machine at predetermined positions in accordance with operations which are the reverse of the above mentioned operations. Such removing and mounting operations are troublesome for operators. However, it is noted that, the above troublesome operations are tolerable in a copying machine of a small scale, but are not tolerable in a large copying machine of console type or the like. With respect to such large machines, because of such maintainance operations, the machines can not be installed near the wall of a room and, thus, a floor space larger than the space occupied by the machine is required for the installation of the machine.

In general, a copying machine has a relatively complicated optical system for exposing a photosensitive paper to a light image of an original. Because of this system the machine housing must be of a large scale so that the optical system can be accomodated in the housing. For example, a conventional optical system comprises a reflective mirror and a projection lens in an arrangement such that a light image formed by the light on an original mounted on an original supporting window is, first, reflected by the mirror and, then, passes through the lens to be focused on a photosensitive paper. Such optical system naturally requires a long path of the light image along the optical axis of the lens to focus the image on the paper and, thus, requires a machine housing of large scale.

There are two kinds of copying machines, one of which is provided with a magazine for supporting a plurality of laminated photosensitive papers, which are supplied, one by one, from the magazine and are subjected to deposition of an electrostatic charge, and then, to exposure to a light image of an original, and the other of which is provided with a roll of photosensitive paper which is cut to the required size by a cutting means to provide a separate paper, which is subsequently subjected to deposition of an electrostatic charge and, then, to exposure to a light image of an original.

The copying machine, in which the roll of photosensitive paper is used, involves a serious problem in that, since the forward portion of the roll paper is cut to the required size while being conveyed toward an electrostatic charger, the cut edge of the paper must be inclined to a direction perpendicular to the paper over the width thereof. In a case where the paper separated from the roll with the inclined cut edge is processed by a copying machine, particularly by a plate making machine, to form a master and the master is used as an original in an automatic printing machine, the inclined cut edge of the master causes not only an unstable gripping of the master for positioning the master, but also, causes production of printed papers wherein the printed images are displaced from predetermined positions. To avoid the above disadvantages, the copying machine must cut the forward portion of a roller paper while the portion is conveyed at a very low speed.

According to the methods for avoiding the above mentioned disadvantages, which are disclosed in the Japanese Utility Model application of Publication No. 992/50 and the Japanese Patent application of Publication No. 27141/51, two pairs of rollers are provided upstream and downstream of the cutting means in the copying machine to cause a slack in a portion of the paper between the two pairs of rollers. The cutting means is actuated to cut the paper at the slack portion thereof. However, such a cutting method has a disadvantage that the cutting means is apt to contact the surface of the slack portion just before cutting, thereby causing scratches and/or partial cuts in the paper which will be copied on papers in the printing machine.

To solve the above disadvantageous problem, there is proposed in Japanese Patent application Disclosure No. 61237/50 a method wherein a first pair of rollers with a one way clutch are provided upstream of the cutting means, while a second pair of rollers with a one way clutch are provided downstream of the cutting means and a third pair of rollers without any one way clutch are provided downstream of the second rollers. After a roll of paper is made slack between the second and third pairs of rollers, the rotations of the first and second pairs of rollers are stopped, and then, the cutting means is actuated to cut the portion of the paper between the first and second pairs of rollers.

According to the above mentioned method, when the first and second pairs of rollers stop, a portion of the paper between the first and second pairs of rollers becomes stationary and tensioned. However, while the cutting means is acting against the tensioned paper portion to be cut between the first and second pairs of rollers, the tension of that paper portion is released so that paper portion is made slack. This is because the one way clutch connected to the first pair of rollers permits the first pair of rollers to rotate so that the paper portion to be cut is fed out of the first pair of rollers when that paper portion is drawn in the downstream direction. That is, the paper portion between the first and second pairs of rollers is cut by the cutting means while that paper portion is caused to be slack by the one way clutch connected to the first pairs of rollers. Therefore, the cutting means can not exhibit its function adequetely. Further, while the cutting means is returning upwardly to a normal position, it is apt to bend the forward portion of the roll paper upwardly with the cut edge. This results in a danger of the paper being jammed in the subsequent processes.

Further, in a case where a roll of paper is to be replaced with a new one of another size, it is difficult to carry out the replacement. This is because the first pair of rollers are not allowed to rotate in such a direction that the forward portion of the paper is caused to move back in the upstream direction through the first pair of rollers. Therefore it is difficult to remove the roll of paper, the forward portion of which is nipped by the first pair of rollers, from the first pair of rollers. If the roll of paper is forcibly removed from the first pair of rollers, the surface of the forward portion of the roll of paper is damaged by scratches due to friction against the rollers.

In the conventional copying machine, a paper cutting device comprises means for setting a length of the paper to be cut to a required value, which means is of a relatively complicated construction. In this respect, it is desirable to provide a length setting means of a simple construction whereby accurate cutting of paper to the required length is ensured.

A copying machine is provided with an original supporting window of glass plate and an original depressing plate means thereon. The original is sandwitched between the supporting window and the depressing plate means.

A well known original depressing plate means consists of a rectangular covering plate of rubber or the like having a substantial weight. The covering plate is pivoted to the original supporting window at one end, while the other free end of the plate has a grip means. The covering plate serves as a weight for depressing the original against the original supporting window. In a case where an original of a large thickness such as a book is placed on the supporting window, the covering plate is required to have weight enough to depress the original in a substantially flat manner. Otherwise, a portion of the original will be spaced apart from the surface of the window and, thus, the light image will be out of focus or the copied image will be distorted. However, a covering plate of an increased weight is a burden to an operator handling the plate, and obstructs the swift operation of the covering plate. Therefore, it is realized that the conventional covering plate means has two contradictory requirements as mentioned above.

Further, the conventional covering plate involves the following problem. The covering plate falls down backwardly when it is turned over from the window. In such case, the operator is required to take an abnormal pose for putting the plate back onto the window. Particularly, in a case where the window is positioned at a high level relative to the floor, the operator is compelled to handle the covering plate in such manner that he stretches himself from the floor.

A copying machine such as an electrophotographic duplicator or an electrophotographic plate making machine is provided with a paper conveying assembly by which papers processed in the copying machine are conveyed successively out of the machine for subsequent process. There are cases where such papers are required to be conveyed from a lower level to a higher level as a matter of convenience for a subsequent process or a manual operation. For example, in a copying machine of a console type, such as a duplicator or a plate making machine, an outlet for the processed papers is provided at a position located at a relatively high level. This is because, with such copying machine, it is required to be easy to take out the processed papers and a printer, in which the processed papers are to be used as a master plate for printing, is provided with a plate positioning station at a position located at a relatively high level. With such copying machine, it is usual to carry out a developing process and a subsequent fixing process in the lower zone of the machine housing. In order to carry out the fixing process, there has been proposed a belt conveyor provided with a suction box disposed therein so as to adhere a paper on the belt surface by means of suction pressure and with a chain delivery assembly having means for chucking the forward end of the paper to be conveyed. However, with such a conveyer, an expensive closed box with a fan or blower is required. This causes the conveyor to be of a relatively complicated construction. The conveyor of such complicated construction has a tendency to become out of order while it is used. Therefore, the conveyor requires troublesome operations for its maintenance in order to use it for a long time.

With the above mentioned chain delivery assembly, it is necessary to incorporate means for detecting the forward end of the paper in the assembly, so that the chucking means can chuck the forward end of the paper. Therefore, the chain delivery assembly becomes expensive.

SUMMARY OF THE INVENTION

Accordingly, it is an object of the present invention to provide an improved electrophotographic copying machine of simple construction, wherein elimination of any defective black frame on a photosensitive paper is ensured.

Another object of the present invention is to provide an improved electrophotographic copying machine having a developing liquid squeezing roller assembly comprising a squeezing roller which is engageable with and disengageable from the squeezing assembly by manual operations from only one side of the machine housing.

A further object of the present invention is to provide an improved electrophotographic copying machine having an optical system of an L shape which allows the machine housing to be of a small scale.

A still further object of the present invention is to provide an improved electro-photographic copying machine having a paper cutting device for a roll of photosensitive paper comprising simple means for setting a cut length of the paper to the required value and means for cutting the paper, wherein portion of the paper is stopped and tensioned while the portion is being cut, so that an accurate cutting of the paper to the required length is ensured without any damage to the surface of the paper.

Another object of the present invention is to provide an improved depressing plate means incorporated in an electrophotographic copying machine, which eliminates the aforementioned disadvantages.

Further object of the present invention is to provide an improved conveying means incorporated in an electrophotographic copying machine which eliminates the aforementioned disadvantages.

According to the present invention, a black frame eliminating mechanism incorporated in an electrophotographic copying machine, comprises:

an original supporting means of a transparent window formed at the upper surface of a housing for supporting an original, said supporting means being designed so that the surface size of said supporting means is larger than that of an original to be copied;

an original depressing plate means adapted to cover said supporting means and having a white inner surface facing the entire surface of said supporting means;

a photosensitive paper positioning means comprising rollers, at least one endless belt having a plurality of suction ports and encircling said rollers and suction means disposed in said endless belt, said positioning means adapted to cause the paper to be adhered to the belt surface and being disposed in said housing so that the surface of the adhered paper is approximately at right angle to the surface of said supporting means;

means for feeding photosensitive papers, one by one to said positioning means, said feeding means comprising means for driving said rollers of said positioning means and means for controlling the drive to said rollers so that the paper is stopped on the surface of said belt at a predetermined position;

exposure means disposed in said housing, comprising a source of light adapted to illuminate the entire surface of said supporting means and an optical system adapted to expose the paper on said positioning means at said predetermined position to the light image from said entire surface of said supporting means, said optical system comprising a projection lens and a reflective mirror which are located in this order along the optical passage so that said lens projects said light image to the paper via said mirror, and;

charging means for depositing electrostatic charge on the surface of the paper while the paper is fed to said positioning means, wherein said charging means being controlled so as to deposit the charge only over the length of a surface portion of the paper substantially the same as or close to the length of a first portion of the paper, which first portion is exposed to the light from the entire surface of the original, while a second surface portion of the paper about said first portion is exposed to the light from the marginal white surface portion of said depressing means about said original, thereby to prevent a formation of a black frame on the paper.

A paper cutting assembly is incorporated in the electrophotographic copying machine. Said cutting assembly comprises:

a roll of paper suspended for rotating freely;

roller means for feeding said roll of paper comprising first rollers disposed downstream of said roll of paper, second rollers disposed on the feeding-out side of said first rollers, and third rollers disposed on the feeding-out side of said second rollers;

means for cutting the portion of said roll of paper between said first and second rollers;

first means for driving said first and second rollers so as to rotate synchronously, said first driving means including first clutch means for transmitting the drive to said first and second rollers and cutting off said transmission of the drive, and second clutch means permitting said second roller to rotate only so as to feed the leading end of the roll paper toward said third rollers;

second means for driving said third rollers;

braking means for stopping the movement of said roll paper at the position of said first rollers or at a position upstream of said first rollers, wherein, while said third rollers continues to rotate by said second driving means, said first clutch means is cut off and said braking means is actuated so that at least the portion of said roll of paper between said first and second rollers is stationary and is tensioned, said cutting means is actuated so as to cut said stationary and tensioned portion of said roll of paper.

A wet developing apparatus is incorporated in the electrophotographic copying machine. Said developing apparatus comprises means for squeezing the developing liquid contained in a developed paper therefrom, said squeezing means comprising a squeezing roller and a driving roller between which the developed paper passes, said squeezing roller being adapted to be disengageable from said driving roller and engageable with said driving roller by manual operations from only one side of said housing.

An original depressing plate assembly is incorporated in the electrophotographic copying machine. Said depressing plate assembly comprises an original supporting table forming a portion of the upper surface of a housing of the machine, said table including an original supporting means of the transparent window located at the central area of said table and an original depressing plate means which comprising:

a depressing plate;

first, second and third pivoting means having first, second and third pivotal axes respectively, and;

spring members, a lateral side end of said plate being pivoted to said table by said first pivoting means, the ends of said spring members being pivoted to said table by said second pivoting means, said second pivotal axis being parallel to said first and third pivotal axes and positioned outside of said lateral side end of said plate, the other ends of said spring members being respectively pivoted to intermediate portions of two opposite side ends of said plate by said third pivoting means, said opposide side ends being perpendicular to said lateral side end, wherein:

a first position of said first pivotal axis is deviated from a second position of said second pivotal axis on a plane perpendicular to said first, second and third pivotal axes;

a straight line, on said plane, extending from said second position and passing through said first position is inclined upwardly to a plane parallel to the surface of said supporting means, and;

said spring members are in stretched states when said plate covers said supporting means.

A paper conveying assembly is incorporated in the electrophotographic copying machine. Said conveying assembly comprises:

conveying means which includes endless belts being inclined and moved in a tensioned condition in a predetermined direction, said endless belts exhibiting friction of a proper coefficent against the paper to be held and conveyed on said belts, and;

compressed air injection means for blowing compressed air against the surface of the paper from above said conveying means.

DESCRIPTION OF THE PREFERRED EMBODIMENTS

Figure 1:
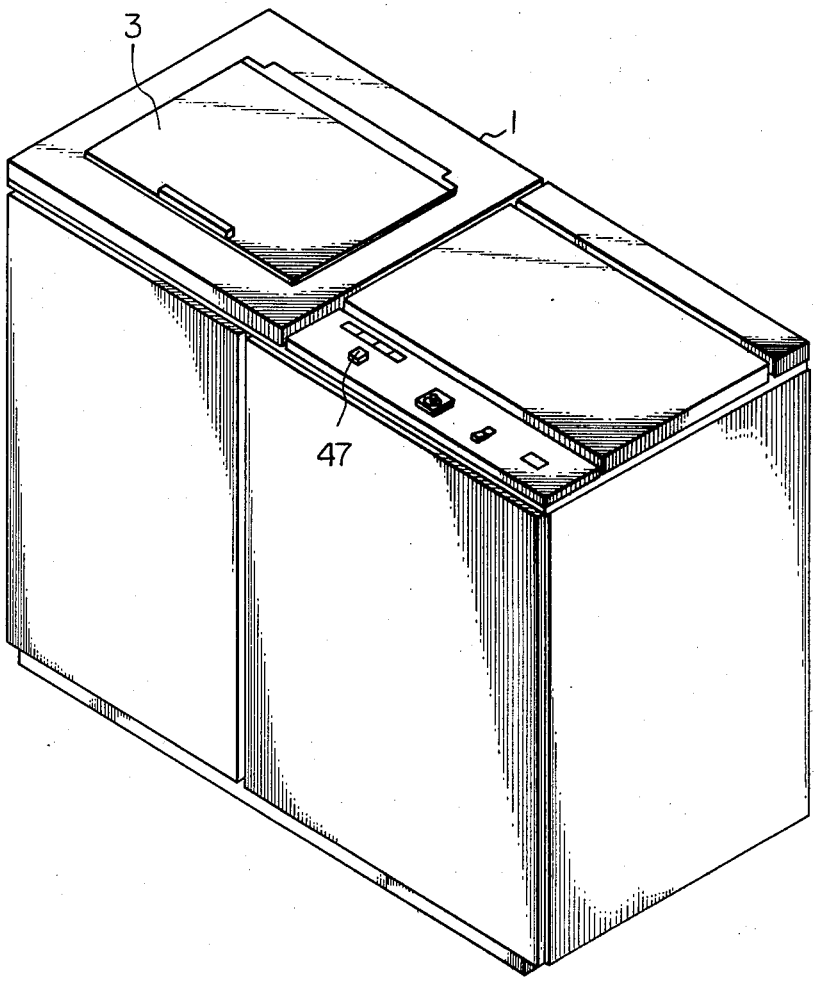
FIG. 1 is a perspective view of a copying machine according to the present invention.
Figure 2:
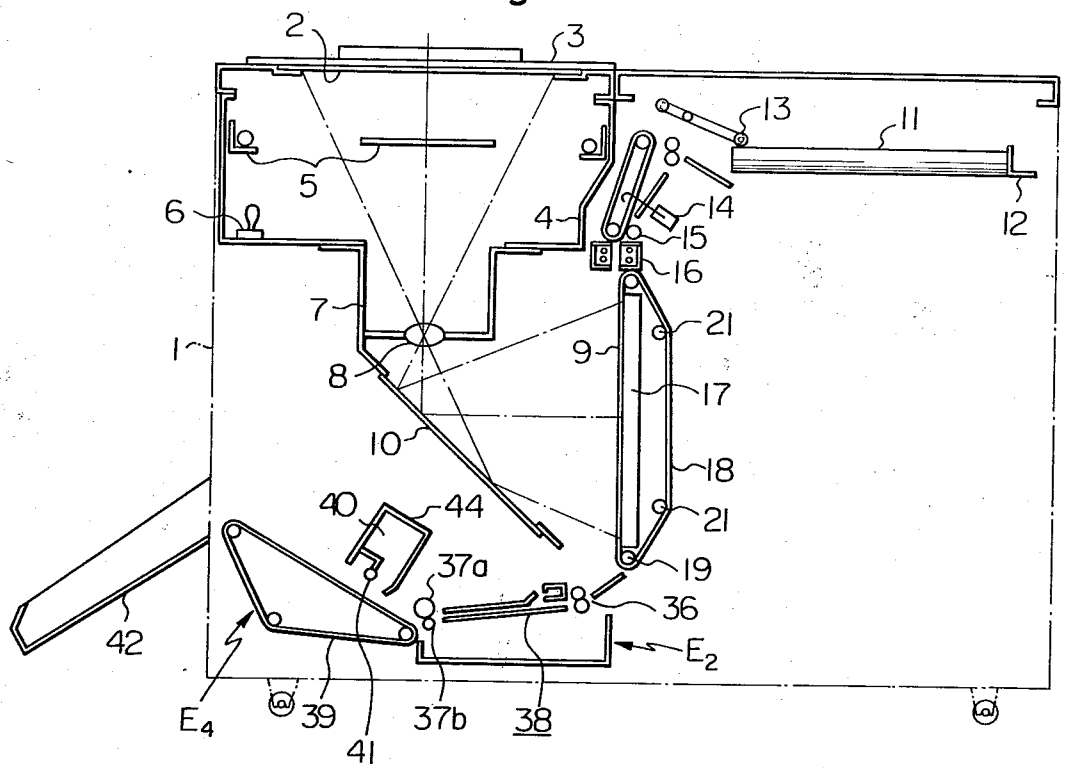
FIG. 2 is a schematic vertical sectional view of the copying machine illustrated in FIG. 1.
Figure 3:
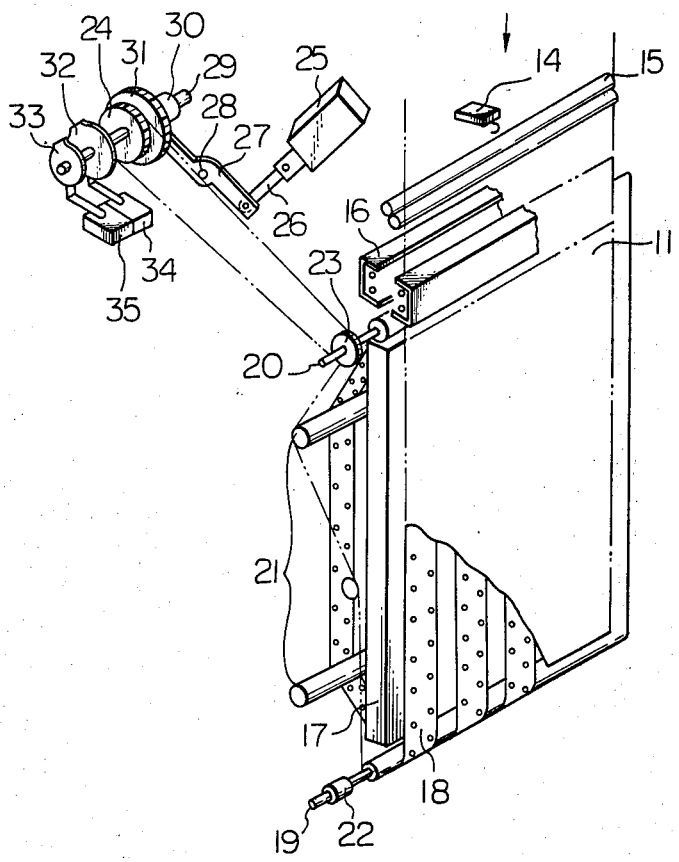
FIG. 3 is an enlarged perspective and partially cut-off view of the paper positioning station as shown in FIG. 1.

A copying machine illustrated in FIGS. 1, 2 and 3, having a black frame eliminating mechanism, is contained in a cubical housing 1. An original supporting window 2 of a transparent plate, such as a glass plate, has a horizontal surface and is provided on the upper horizontal surface of the housing 1. The window 2 can be covered by an original depressing plate 3 provided with a soft lining made of, for example, a synthetic resin. A dark colored opaque box or housing 4 with a T shape is provided beneath the window 2 for the purpose of shielding from light other elements of the machine. A source of light 5 for exposure, including a plurality of linear lamps mounted on a rectangular frame with a L shape is mounted on the intermediate portion of a vertical wall of the box 4. Another source of light 6 is mounted on a shoulder portion of the bottom plate of the box. The light source 6 is provided so that an operator may ascertain if the pattern of the original is contained within a predetermined area of the window 2 and, thus, is designed so that it is turned on when the original depressing plate 3 is turned up from the window 2 by the operator. An optical system mounting base 7, forming the bottom wall of the box 4, is provided with a projection lens 8 arranged so that the optical axis of the lens is directed vertically to a center of the window 2. Further, a reflective mirror 10 is mounted beneath the lens on the base 7 in such a manner that its flat surface is inclined about 45° to the vertical axis of the lens. A photosensitive paper positioning station 9 is provided in the housing 1 at the central position thereof. The station 9 has a vertical surface facing the mirror 10 and, thus, the vertical surface is inclined about 45° to the mirror 10.

A magazine 12 for accommodating and supporting a plurality of laminated photosensitive papers 11 is provided in the upper portion of the housing 1 at a position to the right of the box 4. When a starting switch 47 is turned on, the sheets of the photosensitive paper are supplied, one by one, by a feeding unit 13 positioned at the front end of the magazine 12. The supplied paper pushes a conveyer control switch 14 on and, while pushing the switch on, is conveyed by a pair of feeding rollers 15 to charging devices 16, which may be corona discharge devices. The paper is then conveyed in a downstream direction to the photosensitive paper positioning station 9. The station 9, as shown in FIG. 3, comprises a driving roller 19, a driven roller 20 and tensioning rollers 21, and endless conveyor belts 18 encircling these rollers. The conveyor belts 18 have a plurality of suction ports adapted for causing the paper to be adhered to the belt surfaces. The station 9 also comprises a suction box 17 having a perforated face. The box is disposed inside the conveyor belts and is provided at its bottom with a fan. The paper 11 supplied onto the belts 18 is caused to adhere to the belts by the suction produced by the fan, and is conveyed to a predetermined position for exposure.

An electro-magnetic clutch 22, for driving and stopping the belts 18, is mounted to the end of the driving roller 19. A sprocket 23 is secured to the end of the driven roller 20. A shaft 29 is mounted rotatably to fixed members of the machine. A driving gear 31 is connected to the shaft 29 via a well-known one-revolution clutch 30, and a sprocket 24 and a pair of peripheral cams 32 and 33 are secured to the shaft 29. The cams 32 and 33 have phase angles which are different from each other in their rotational directions. The sprocket 23 is connected to the sprocket 24 by a chain. The one-revolution clutch 30 can be engaged with a pawl 27 which is pivoted by a pivot 28 to a fixed member of the machine. A solenoid 25 is secured to a fixed frame of the machine. This solenoid 25 is connected to the pawl 27 by means of a lever 26 secured to the solenoid and pivoted to the pawl. The gear 31 is driven to rotate by a driving source (not shown) via a gear transmission (not shown), when a start switch 47 is turned on. The gear 31 transmits the one-revolution to the shaft 29 via the one-revolution clutch 30, when the clutch 30 is disengaged from the pawl 27. A pair of limit switches 34 and 35 are mounted to a fixed member of the machine, and are positioned so that they cooperate with the cams 32 and 33, respectively.

Figure 8:
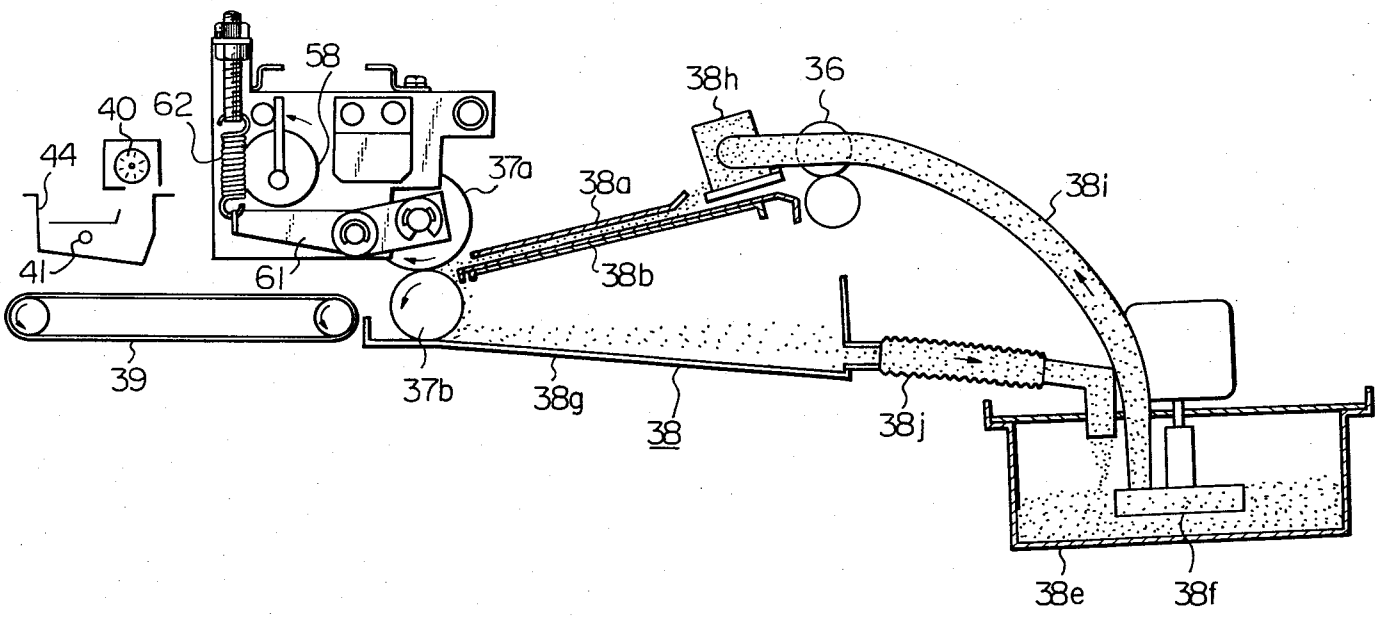
FIG. 8 is a diagram showing the developing apparatus according to the present invention.

Beneath the mirror 10 and the paper positioning station 9, there is provided a wet developing device comprising first and second pairs of rollers 36 and 37 and a developing section 38. A detailed indication of the construction of the developing section 38 is omitted in FIG. 3. However, the corresponding construction is shown in detail in FIG. 8. Referring to FIG. 8, the developing section 38 comprises an electrode plate 38*a*, a guide plate 38*b*, a developing liquid supplying device 38*h*, a receiver 38*g* for collecting the liquid, and a tank 38*e* with a pump 38*f* and conduits 38*i* and 38*j* connected to the receiver 38*g* and the liquid supplying device 38*h*. In FIG. 8, the first and second pairs of rollers 36 and 37 are spaced apart from each other in the forwarding direction of the paper. Between these rollers 36 and 37, the electrode plate 38*a* and the guide plate 38*b* are disposed. The upper one of the rollers 37 is provided for squeezing the liquid from the developed paper and is numbered as 37*a*, while the lower one of the rollers 37 is a driving roller and is numbered as 37*b*. A paper exhausting device 39 of a conveyor type is provided downstream of the rollers 37. Over the paper exhausting device 39, there is provided a drying device 44 comprising a fan 40 and a heater 41. A shooter 42 is provided downstream of the exhausting device 39 and is extended outwardly from the left wall of the housing 1.

Figure 4A:
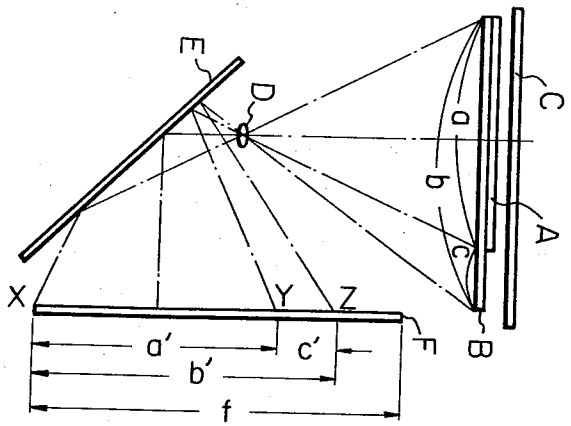
FIGS. 4A and 4B are diagrams utilized to explain operations of the black frame eliminating mechanism according to the present invention.
Figure 4B:
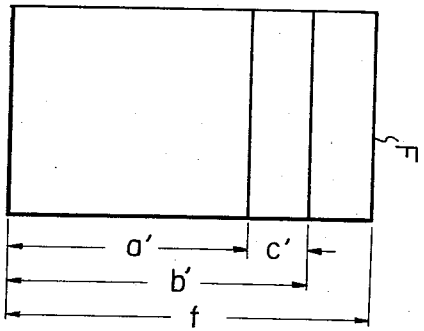

The technical principle of the black frame eliminating mechanism according to the present invention will now be described with reference to FIGS. 4A and 4B. In those figures, A denotes an original or a manuscript, B denotes an original supporting window, C denotes an original depressing plate having a white surface facing the window B, D denotes a projection lens, E denotes a reflective mirror and F denotes a photosensitive sheet of paper.

It is assumed that the surface area of the window B is slightly larger than that of the original A, and the original A is mounted on the window B and is covered with the depressing plate C. If the copying machine is operated to feed a photosensitive sheet of paper from the magazine to the paper positioning station through the charge device, the paper is charged with an electrostatic charge while passing through the actuated charge device and, then, the charged paper is stopped at the predetermined position on the positioning station.

The relationship between the stop position of the charged paper F and the exposure position of the paper F will now be explained. As shown in FIG. 4A, it is assumed that the length of the original A is "a", the length of the window B is "b", the length of the marginal portion of the window B around the original A is "c" and the length of the paper F is "f". In the entire portion of the paper F exposed to the light by the optical system including the lens D and the mirror E, a part corresponding to the original A has a length of "a'", a second part corresponding to the window B has a length of "b'", and a marginal part corresponding to the marginal portion c has a length of "c'".

According to the present invention, the charging device is controlled so that the length of the charged part of the paper coincides approximately with the length "a'", that is the length of the first part corresponding to the original A. The exposure position is determined so that the length "b'" of the exposed part of the paper is slightly longer than the charged length "a'" of the paper, with the result that the exposed part overlaps the marginal part of the length "c'", while the marginal part is not charged.

For the above purpose, the paper positioning station and the charge device of the present invention are designed so that, in their combination, while a paper is charged, the forward end of the paper is conveyed and is stopped at a position "X", and the deposition of the charge on the paper terminates at a position "Y". The charged and stopped paper is then subjected to a subsequent exposure. In the exposure process, an electrostatic latent image corresponding to the image with a length of "a" of the original A formed by the exposure to the light is formed on the paper with a length of "a'".

When the window B with the length of "b" is exposed to the light, an electrostatic latent image corresponding to the image of the original A with the length "a" formed by the exposure to a part of the light is formed on the paper with a length of "a'". The marginal portion of the window with the length "c" is exposed to the other part of the light. The light which has passed through the marginal portion of the window B is reflected to the white surface of the depressing plate C, and thus, the reflected light passes through the window B and the lens D, and is reflected to the mirror E, so that the marginal part of the paper F with the length of "c'" is exposed to the reflected light. As a result, the image of the white surface of the depressing plate C is projected onto the marginal part of the paper which is not charged. The marginal part becomes white without any pattern when the paper is subjected to the subsequent development. Therefore, even if the terminal position "Y" of the charge deposition and/or the stop position "X" of the paper are varied according to a possible variation of the feed speed of the paper, and/or owing to a wrong timing in the actuation of the means for stopping the charge deposition, and such variations cause occurrence of enlargement in area of the charge deposition to overlap the marginal part with the length "c'", that is occurrence of a latent black frame, such black frame is eliminated in the subsequent exposure process. This is because the marginal part with the length "c'" is exposed to the light image of the white surface of the depressing plate C, so that a latent image without any pattern is formed on the marginal part. Therefore, in the subsequent developing process the developed paper has a light image of the original without any black frame.

Briefly stated, the black frame eliminating mechanism of the present invention comprises an original supporting window B, the length of which is slightly longer than that of an original A, an original depressing plate having a white surface facing the window B, means for depositing a charge over the length of a portion of a photosensitive paper F which length corresponds to that of the original A, and means for exposing the paper F to the light image from the entire area of the window B. Even if a latent black frame occurs prior to the exposure process due to a problem in the machine, such black frame is eliminated instantly whenever the paper is subjected to the exposure to the light from the window. As a result, when the exposed paper is developed, the developed paper has no visible black frame on it.

Figure 4C:
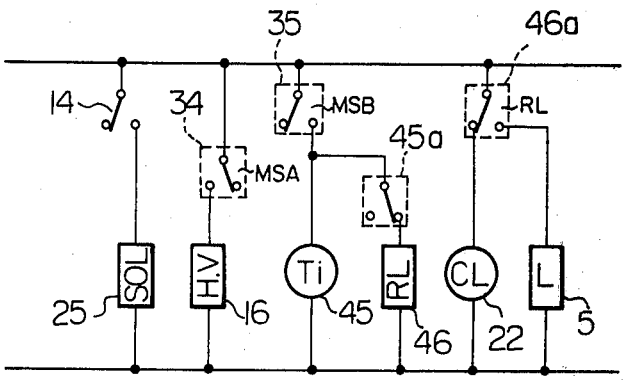
FIG. 4C is a diagram showing an electric circuit used for carrying out paper feeding operations, electrostatic charging operations and paper positioning operations in the black frame eliminating mechanism.
Figure 4D:
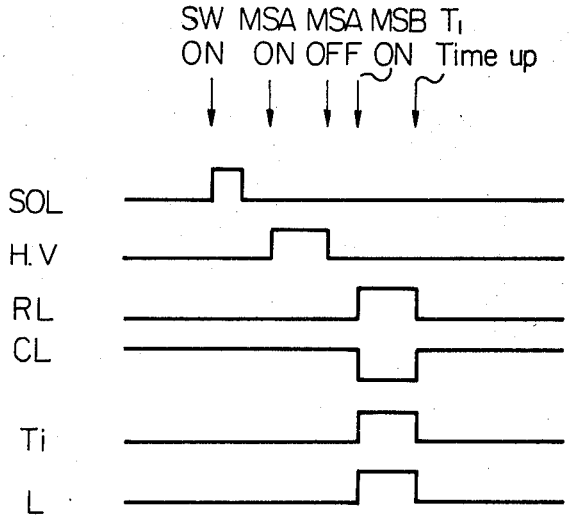
FIG. 4D is a diagram showing signal wave forms of the circuit indicated in FIG. 4C.

An embodiment of the black frame eliminating mechanism according to the present invention will be described with reference to FIGS. 3, 4C and 4D. FIG. 4C illustrates an example of the electric circuit for operating the mechanism indicated in FIG. 3, and FIG. 4D illustrates signal wave forms in the circuit.

When the conveyer switch 14 is turned on, the solenoid 25 is energized so that the one-revolution clutch is disengaged from the pawl 27 to permit one revolution of a pair of the cams, that is the charge controlling cam 32 and the conveyor controlling cam 33. When the projection of the cam 32 turns the switch 34 on, the charge device 16 is actuated, and when the projection is removed from the switch 34, the operation of the charge device is stopped. When the projection of the cam 33 turns the switch 35 on, an exposure timer 45 is triggered and a relay 46 is energized, so that the clutch 22 for driving the conveyor belts is cut off and the light source 5 for exposure is turned on. The clutch 22 is connected to a contact 46*a* of the relay 46. When the exposure is terminated, a contact 45 of the timer 45 is switched over to release the relay 46 so that the clutch 22 is energized through the contact 46*a*.

Referring to FIG. 3, the photosensitive paper 11, which has been dispatched from a magazine (not shown), is fed to the charge device 16 by the feed rollers 15 while it is pushing the conveyor switch 14 on and is charged on its surface. The paper 11 passes through the charge device 16 and, then, is conveyed downwardly by the endless conveying belts 18, as shown by an arrow, to a predetermined exposure position while it is adhered onto the surfaces of the belts by suction.

When the paper 11 turns the switch 14 on, the charging operation is commenced and, after a predetermined time has elapsed, the charging is terminated as explained before. In this case, the length of the projection of the cam 32 is designed so that the charged area of the paper is slightly smaller than the exposed area of the paper.

When the projection of the cam 33 turns the switch 35 on, the rotation of the endless belts 18 is stopped and, thus, the paper 11 is stopped at the predetermined exposure position as explained before. Concurrently, the light source 5 is turned on and, thus, the reflected light image is focused onto the paper by means of the optical system comprising the lens 8 and the reflective mirror 10.

The black frame eliminating mechanism mentioned above has advantages that the length of the photosensitive paper is not restricted to a special range as in the conventional copying machine, it is of a very simple construction and it prevents the formation of the black frame effectively.

Figure 5A:
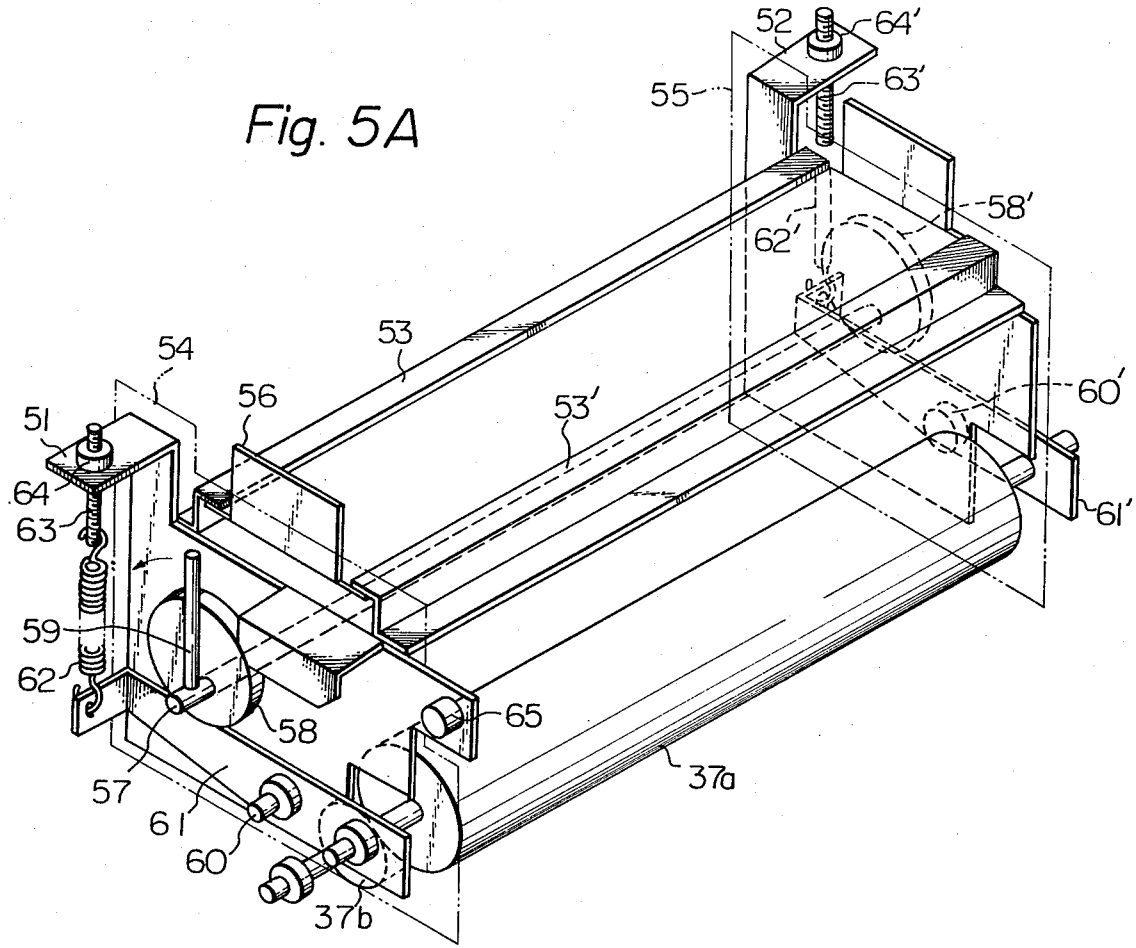
FIG. 5A is a perspective view of the squeezing roller assembly according to the present invention.
Figure 5B:
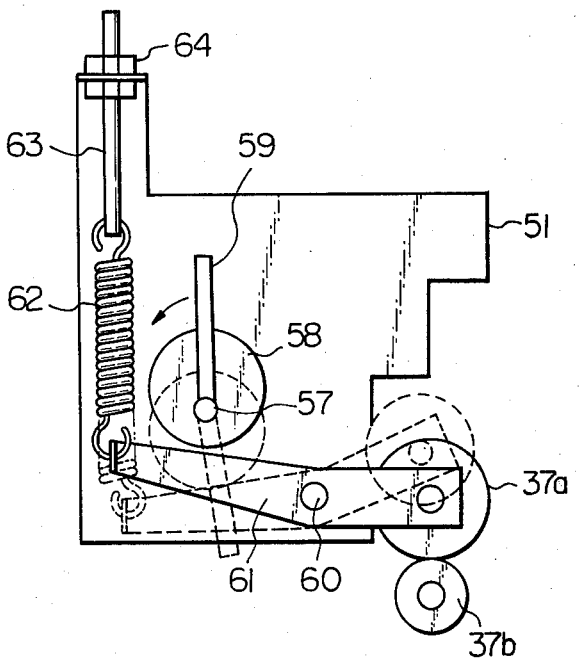
FIG. 5B is an elevational view of the squeezing roller assembly illustrated in FIG. 5A.

Another feature of the improved copying machine according to the present invention resides in a squeezing roller assembly. FIGS. 5A and 5B show an embodiment of the squeezing roller assembly.

As shown in FIG. 2, after the paper is subjected to the charge deposition and then the exposure, the paper 11 is sent to the developing section 38, where it is developed with the developing liquid so as to have a visible picture which is changed from the latent image. The developing liquid contained in the developed paper 11 is squeezed out of the paper by the squeezing roller 37*a* and the driving roller 37*b*, in combination, while the paper passes between the rollers, and then, the paper is fed to the drying device 44.

Referring to FIGS. 5A and 5B, the squeezing roller assembly consists of a fixed unit and a removable unit. The fixed unit comprises a pair of front and rear frames 54 and 55 fixed to the machine, which frames are secured to a guide rail 56. The removable unit comprises the squeezing roller 37*a* and a pair of front side and rear side plates 51 and 52. The removable unit is secured to the fixed unit by fixing the front frame 54 to the front side plate 51 with a fixing screw 65.

The side plates 51 and 52 are in a parallel arrangement, and a pair of parallel rails 53 and 53' are disposed traversely between and secured to the side plates. The front frame 54 and the rear frame 55 in a parallel arrangement are provided with the guide rail 56 disposed traversely between and secured to the frames, so that the pair of rails 53 and 53' are slidable against the rail 56. Such slidable construction is intended to allow the removable unit to be disengaged from and engaged with the machine by simple manual operations in a single direction. The driving roller 37*b* is rotatably mounted to the front frame 54 and the rear frame 55. Further a rotatable shaft 57 is rotatably mounted to the frames 54 and 55. The roller 37*b* and the shaft 57 are spaced apart from each other. The shaft 57 has eccentric cams 58 and 58' and its ends, and a lever 59 is secured to the end of an extension of the shaft from the cam 58.

The front frame 51 and the rear frame 52 are provided with pivots 60 and 60', respectively, and levers 61 and 61' are pivoted to the frames 51 and 52 by means of the pivots 60 and 60', respectively. The squeezing roller 37*a* is located between the levers 61 and 61' and is rotatably mounted to the ends of the levers. A coil spring 62 is connected to the front frame 51 and the other end of the front lever 61 via a pressure adjusting screw 63 with a nut 64, while another coil spring 62' is connected to the rear frame 52 and the other end of the rear lever 61' via a pressure adjusting screw 63' with a nut 64'. These springs and screws with the nuts are provided for the purpose of urging the roller 37*a* against the the roller 37*b*.

The eccentric cams 58 and 58' are designed so that the circumferential surfaces are not contacted with the levers 61 and 61' when the squeezing roller 37*a* is urged against the driving roller 37*b* by the springs 62 and 62'. In FIG. 5B, the case where the roller 37*a* is urged against the roller 37*b* is indicated with solid lines. When the lever 59 is rotated in the direction shown by an arrow, the eccentric cams 58 and 58' are rotated together with the shaft 57 and, thus, the circumferential surfaces of the cams cause the levers 61 and 61' to rotate the pivots, in accordance with the eccentricity of the cams, to the position as shown by dotted lines, for example. In such case, the springs 62 and 62' are elongated and the squeezing roller 37*a* is disengaged from the driving roller 37*b*. At this stage, if the fixing screw 65 is disengaged from the frame 54, the removable unit can be removed from the machine along the guide rail 56. Therefore, it is easy to wash and clean the squeezing roller 37*a* or to replace the roller 37*a* with a new one.

After the squeezing roller is washed or replaced, the removable unit is smoothly inserted into the fixed unit by means of the pair of rails 53, guided by the guide rail 56, and is fixed to the fixed unit by means of the fixing screw 65. The engagement of the squeezing roller 37*a* with the driving roller 37*b* is completed by rotating the lever 59 in a direction opposite to the direction of the arrow.

In the copying machine in which the above squeezing roller assembly is incorporated, production of copies with stable and high quality is ensured, since the squeezing roller is easily removable by simple manual operations for the purpose of washing or replacing the roller. Further, such machine has an advantage that the floor area necessary for installation of the machine is reduced compared with the conventional machines, since the squeezing roller may be removed by manual operations from one side wall of the machine.

Still another feature of the present invention resides in the optical system shown in FIG. 2. In the optical system, the light source 5 for exposure illuminates the entire surface of the paper supporting window 2. The light reflected by the window 2 is firstly concentrated by the projection lens 8, and the light which has passed through the lens 8 then reaches the reflective mirror 10. The light is reflected by the mirror 10 so that it is directed to the paper positioning station 9. The optical aixs of the lens 8 is vertical and the surface of the station 9 on which a photosensitive paper is mounted is in a vertical plane. The reflective surface of the mirror 10 is inclined about 45° to the optical axis of the lens. According to the above arrangement of the optical system, the light reflected by the original reaches the photosensitive paper through the lens and the mirror in this order along the optical passage. Such light passage is arranged in a vertical plane and is of an L shape, and this L shaped optical system allows the size of the housing of the copying machine to be reduced compared with a copying machine accommodating the conventional optical system.

The operations of the above described copying machine will now be explained with reference to FIGS. 1, 2 and 3.

When the paper depressing plate 3 is turned up by an operator in order to mount the original to be copied on the paper supporting window 2, the light source is turned on to illuminate the window 2. The operator then sets the original onto the upper surface of the window 2. In the setting operation, the operator observes the original, which is illuminated by the light from the light source 6 passing upwardly through the window 2 and the original, and ascertains if the picture of the original is located within the predetermined zone of the window, and then, adjusts the position of the original as necessary.

When the start switch 47, for actuating a main motor used as a driving source for the rotational elements in the machine, is pushed on, a sheet of the photosensitive paper 11 in the magazine 12 is dispatched out of the magazine. The dispatched paper 11 is supplied into the charge device 16 by the pair of feed rollers 15, while the paper is pushing the feed controlling switch 14 on. While the paper is passing through the charge device 16, a charge is deposited on the surface of the paper. The paper passes through the charge device and, then, is conveyed to the predetermined exposure position on the paper positioning station 9, while it is adhered to the surfaces of the endless belts 18.

When the feed controlling switch 14 is pushed on as described above, the solenoid 25 is energized to actuate the pawl 27 and, thus, the one-revolution clutch 30 is released from the pawl 27. Upon this release the charge controlling cam 32 and the paper stopping cam 33 commence their rotations. Accordingly, the cam 32 pushes the charge controlling switch 34 on to actuate the charge device 16, so that the charge deposition on the surface of the paper begins. When the projection of the cam 32 is removed from the switch 34, the charge deposition is terminated. Subsequent to the termination of the charge deposition, the paper stopping cam 33 pushes the paper stopping switch 35 on and, thus, the clutch 22 is cut off so that transmission of the rotation to the driving roller 19 via the clutch 22 is stopped. Accordingly, the rotation of the endless belts 18 is stopped and, thus, the paper stops at the predetermined exposure position on the station 9.

Concurrently with the stopping of the paper, the light source 5 for exposure is turned on to illustrate the window 2. Thus, the light image from the window 2, including the light image of the original and the light image of a marginal portion of the paper depressing plate 3 around the original, passes through the lens 8, and then, is reflected by the mirror 10 and focused on the stationary paper. Even if a latent black frame has been formed in the changing process, the black frame would be eliminated in the above exposing process. The driving roller 19 is driven to rotate when the projection of the cam 33 is removed from the switch 35 and, thus, the paper having an electrostatic latent image of the original is conveyed to the pair of rollers 36 by which the paper is then supplied into the developing section 38. In the developing section 38, the latent image is changed into a visible image with the toner. The developed paper is conveyed into the squeezing assembly as shown in FIGS. 5A and 5B, where the surplus developing liquid contained in the paper is squeezed out from the paper by cooperation of the squeezing roller 37*a* and the driving roller 37*b*. The squeezed paper is then fed to the paper exhausting device 39. While the paper is conveyed by the exhausting device 39, it is dried by the drying device 44. Lastly, the dried paper is exhausted from the machine through the shooter 42.

Figure 6:
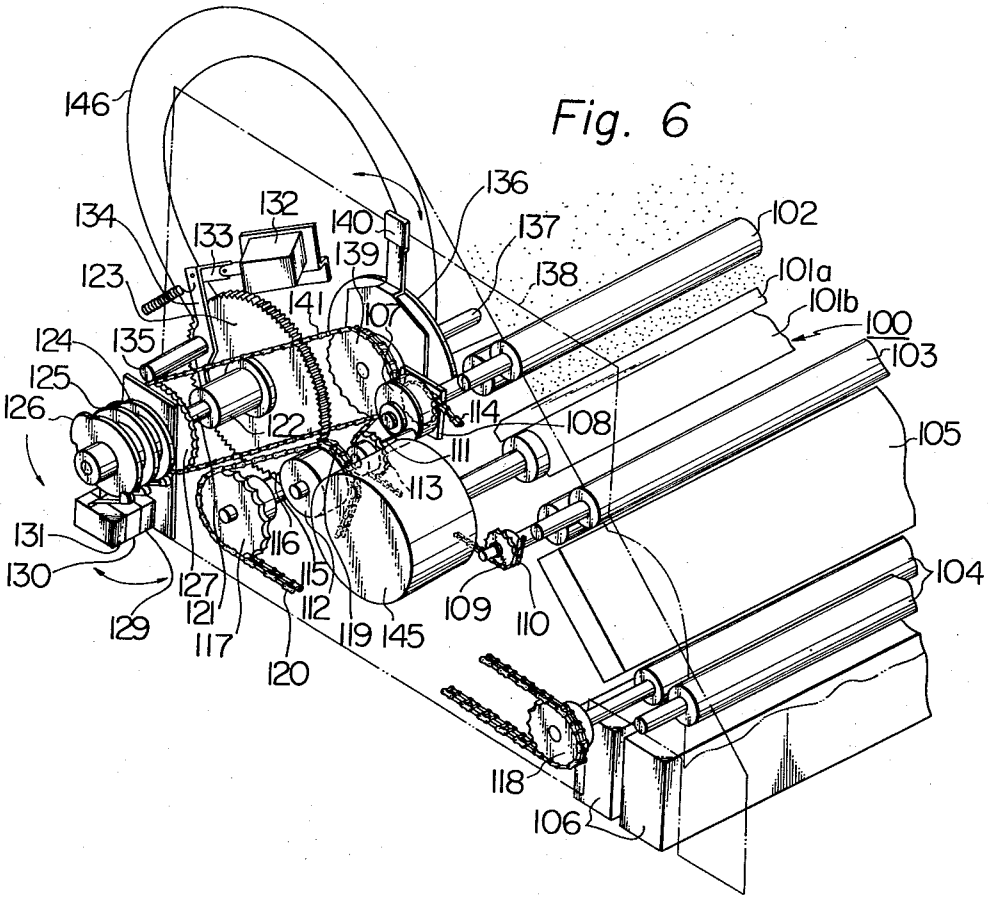
FIG. 6 is an enlarged perspective and partially view of the paper cutting apparatus according to the present invention.
Figure 7A:
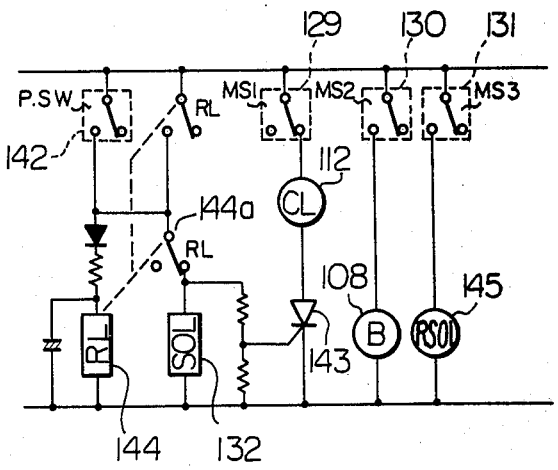
FIG. 7A is a diagram showing an electric circuit used for operating the apparatus shown in FIG. 6.
Figure 7B:
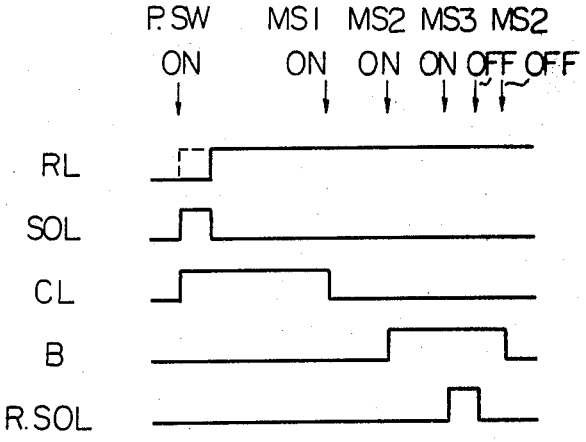
FIG. 7B is a diagram showing signal wave forms of the circuit shown in FIG. 7A.

The present invention includes an improved paper cutting assembly, incorporated in a copying machine, for a roll of photosensitive paper, which assembly is shown in FIG. 6 and FIGS. 7A and 7B. Referring to FIG. 6, the paper cutting assembly comprise means 100 for cutting the paper. The cutting means 100 include a stationary cutting edge 101*a* and a rotary cutting edge 101*b*. A first pair of feed rollers 102 are provided upstream of the cutting means 100, while a second pair of feed rollers 103 are provided downstream of the first pair of rollers 102. Further, a third pair of feed rollers 104 are provided downstream or on the feeding-out side of the second pair of feed rollers 103. Between the second pair of feed rollers 103 and the third pair of feed rollers 104, a guide plate 105 is located for guiding a roller paper fed out of the second pair of feed rollers 103. Beneath the third pair of feed rollers 104, there is disposed a charge device 106, which corresponds to the charge device 16 shown in FIG. 3. The first pair of feed rollers 102 have outerdiameters which are the same as those of the second pair of feed rollers 103, while the third pair of feed rollers 104 have outerdiameters slightly smaller than those of the first and second pairs of feed rollers.

The first pair of feed roller 102 consists of a first driving roller 102*a* and a first driven roller 102*b*. A sprocket 107 provided with an electromagnetic brake 108 is secured to the end of the first driving roller 102*a*. The second pair of feed rollers 103 are a second driving roller 103*a* and a second driven roller 103*b*. A sprocket 110 is connected to the end of the second driving roller 103*a* via a one-way clutch 109. The one-way clutch 109 is designed so that it allows the second driving roller 103*a* to rotate freely in one-way so as to feed the paper in a downstream direction. The application of the brake 108 to the first pair of feed roller 102 has the advantageous features described hereinafter.

A driving shaft 111 is provided to drive the first and second driving rollers 102*a* and 103*a*, while another driving shaft 115 is provided to drive the third driving roller 104*a*. A sprocket 113 is connected to the shaft 111 via an electromagnetic clutch 112. A chain 114 is wound around the sprockets 107, 110 and 113, so as to transmit the rotation of the sprocket 113 to the first and second driving rollers 102*a* and 103*a*, when the clutch 112 is energized. The rotation of the roller 102*a* is synchronized with that of the roller 103*a*.

A gear 116 and a sprocket 117 are secured to the end of the shaft 115. A sprocket 119 is secured to the clutch 112, while another sprocket 118 is secured to the end of the third driving roller 104*a*. The sprockets 117, 118 and 119 are connected to a driving means (not shown) by means of a chain 120 so as to be driven to rotate by the driving means. The above described arrangement is designed so that the difference between the higher paper velocity of the second pair of feed rollers 103 and the lower paper feed velocity of the third pair of feed rollers 104 causes formation of a slack portion of the paper over the guide plate 105 and between the second and third pairs of feed rollers. Such difference in the feed velocities is caused by the difference between the outer diameters of the second and third driving rollers 103*a* and 104*a*, so long as the two rollers are driven to rotate at a synchronous rotational speed.

A shaft 121 is also provided in the paper cutting device. A gear 123 is connected to the shaft 121 via a one-revolution clutch 122, and further, a feed controlling cam 124, a break controlling cam 125 and a cutter controlling cam 126 are secured to the shaft 121. These cams are peripheral cams, as shown in FIG. 3. Still further, a sprocket 127, to which a switch mounting plate 128 is secured, is mounted rotatably to the shaft 121. A feed controlling switch 129, a brake controlling switch 130 and a cutter controlling switch 131 are mounted onto the surface of the plate 128. These switches 129, 130 and 131 are rotatable together with the sprocket 127. The gear 116 secured to the shaft 115 is engaged with the gear 123 mounted to the shaft 121 via the one-revolution clutch 122, so that rotation of the shaft 115 is transmitted to the gear 123.

A solenoid 132 is provided to control the one-revolution clutch 122. A pawl 134, to be engaged with the one-revolution clutch 122, is connected to the solenoid 132 via a lever 133 secured to the solenoid 132. The lever is pivoted to the pawl 134 and the pawl 134 is pivoted to a fixed frame of the cutting device by a pivot 135. In the above described arrangement, when the solenoid 132 is energized, the one-revolution clutch 122 is disengaged from the pawl 134, so that the rotation of the gear 123 is transmitted to the shaft 121. The shaft 121 is permitted to rotate through only one-revolution.

The cutting assembly has a fixed frame 138 where a cut length scale board 136 is secured. The scale board 136 has scales of the length to be cut which are located circumferentially on its surface. A shaft 137 is secured to the scale board at the center thereof. A sprocket 139 is rotatably mounted to the shaft 137, and is provided with a dial 140 which is rotatable together with the sprocket 139. The sprockets 127 and 139 are connected via a chain 141 so that rotation of the dial in either direction, as shown by an arrow, is transmitted to the switches 124, 125 and 126, which are rotatable as a unit. Thus, the initial phase angles of the cams relative to the corresponding switches are set in correspondence with the length indicated by the dial on the scale board.

FIG. 7A illustrates an example of the electric circuit for operating the mechanism indicated in FIG. 6, and FIG. 7B illustrates signal wave forms in the circuit. Referring to FIGS. 7A and 7B, while the sprockets 117, 118 and 119 are rotated, a printing switch 142 is turned on. By this action, the solenoid 132 is energized and a thyristor 143 is turned on so that the electromagnetic clutch 112 is energized. A relay 144 is actuated to switch over the contact 144*a* of the relay by an output signal from a delay circuit and, thus, the solenoid 132 is de-energized, while the clutch 112 remains in the energized state.

When the one-revolution clutch 122 is disengaged from the pawl 134, that is "cut off" by the actuation of the solenoid 132, the feed controlling cam 124, the brake controlling cam 125 and the cutter controlling cams are, in combination, permitted to rotate together with the shaft 121 through only one-revolution during the period between the time when the pawl 134 disengages from a slot (not shown) of the clutch 122 and the time when the pawl reengages with the slot. While the shaft 121 is rotated, as shown in FIG. 7B, the feed controlling switch 129 is, at first, pushed on by the projection of the corresponding cam 124 and, thus, the electromagnetic clutch 112 is cut off. Then, the brake controlling switch 130 is pushed on by the projection of the corresponding cam 125 and, thus, the electromagnetic brake 108 is energized. Lastly the cutter controlling switch 131 is pushed on by the projection of the corresponding cam 126 and, thus, a rotary solenoid 145, by which the rotary cutting edge 101*b* is rotated, is energized. Whhen the cutting operation of the cutting means 101 is completed, the brake controlling switch 125 is disengaged from the projection of the corresponding cam 125 and, thus, the brake 108 is disenergized.

In the above described arrangement, it is now assumed that the cut length of the roll paper, that is the length of the sheet, is 400 mm. In this case, the indicator 140 is adjusted to the scale of 400 mm on the scale board 136 by an operator. In accordance with this adjusting operation, the switch assembly, consisting of the controlling switches 129, 130 and 131, is forced to rotate, that is the indicated length is set. In the state where the sprockets 117, 118 and 119 are rotated by the driving source, when the printing switch 142 is turned on, the electromagnetic clutch 112 is energized to allow the first and second driving rollers 102*a* and 103*a* to rotate synchronously. As a result, the roll paper 146 is forced to run in a downstream direction by the first and second pairs of feed rollers 102 and 103. Simultaneously, the solenoid 132 is energized for disengaging the pawl 134 from the one-revolution clutch 122, and thus, the gear 116 is permitted to transmit its rotation to the gear 123, that is, the rotation of the gear 116 is transmitted to the cams 124, 125 and 126. The roller paper is forced to run along the guide plate 125, and then, its forward end reaches the third pair of feed rollers 104, and passes between the rollers 104. In this case, a portion of the roller paper 146 between the second and third pairs of feed rollers 103 and 104 is caused to be slack over the guide plate 105 by the difference between the feed velocities of the second and third pairs of feed rollers 103 and 104, with the velocity of the latter being lower than the velocity of the former. In this slack state, at first, the feed controlling cam 124 pushes the corresponding cam 129 on for cutting the clutch 112 off, and thus, the rotations of the first and second pair of feed rollers 102 and 103 are stopped and the feed of the paper is stopped. Simultaneously, the brake controlling cam 125 pushes the corresponding switch 130 on for energizing the electromagnetic clutch 108. According to the above described operations, the feed of the roll paper 146 is stopped, while a portion of the paper, between the first pair of feed rollers 102 having the brake 108 and the second pair of feed rollers 103 having the one-way clutch 109, is tensioned by incooperation of the brake 108 with the one-way clutch 109. Subsequent to the stopping of the paper feed, the cutter controlling cam 126 pushes the corresponding switch 131 on for energizing the rotary solenoid 145, so that the rotary cutting edge 101*b* is actuated against the stationary cutting edge 101*a*. As a result, the cutting means 101 is permitted to cut the roll paper 146 in a stationary state at the tensioned portion thereof.

After the cutting operation is completed, the projection of the brake controlling cam 125 is disengaged from the corresponding switch 130, and thus, the electromagnetic brake 108 is disenergized. Further, the slack of the paper portion between the second and third pairs of feed rollers 103 and 104 is eliminated, because the third pair of feed rollers 104 continues to rotate. Then, the second pair of feed rollers 103, having the one-way clutch 109, is driven by the sheet of paper cut from the roll paper, which sheet is running in a downstream direction, and the cut sheet is dispatched out of the rollers 103 in a downstream direction. Upon the dispatch of the cut sheet, rotation of the second pair of feed rollers 103 stops. The cut sheet is dispatched to the charge device 106 by the third pair of feed rollers 104.

The above descriptions are directed to the embodiment wherein the first pair of feed rollers 102 are provided with the braking means for stopping the movement of the paper. However, the scope of the present invention is not limited to such an embodiment. That is, the paper feed may be stopped not only by means of the first pair of feed rollers 102 provided with the brake 108, but also by any other means positioned upstream of the rollers 102 so as to act against the paper. For example, a shaft (not shown) for suspending the roll of paper may be provided with braking means such as that of the above embodiment in order to tension the stationary paper portion between the roll and the second pair of feed rollers 103. In this case, the stationary paper portion between the first and second pairs of rollers 102 and 103 is naturally tensioned. Alternatively, it is possible to adopt a braking means for stopping the movement of the roll by means of a frictional plate applied to a boss member around which a paper is wound to form a roll. Furthermore, in a case where a photosensitive paper is wound to form a roll with the photosensitive surface forming the outer surface of the roll, it is possible to adopt such a friction plate as above so as to act directly against the outer surface of the roll.

As will be understood from the above explanations, according to the present invention, a portion of the roll paper to be cut is forced to be stationary and tensioned while it is cut, by the braking means for stopping the movement of the paper. The braking means is provided so as to act against the paper either at the first pair of feed rollers or at a position upstream of the first pair of feed rollers. This ensures the cutting means cutting the forward portion of the roll paper accurately to the required length, which can be determined by a length setting means of simple construction, and; further, eliminates the danger of the forward end of the roll paper which has been cut, being jammed, since any defective slack or fold of such forward end, or any defective inclination of the cut edge to the direction perpendicular to the paper does not occur.

Figure 9:
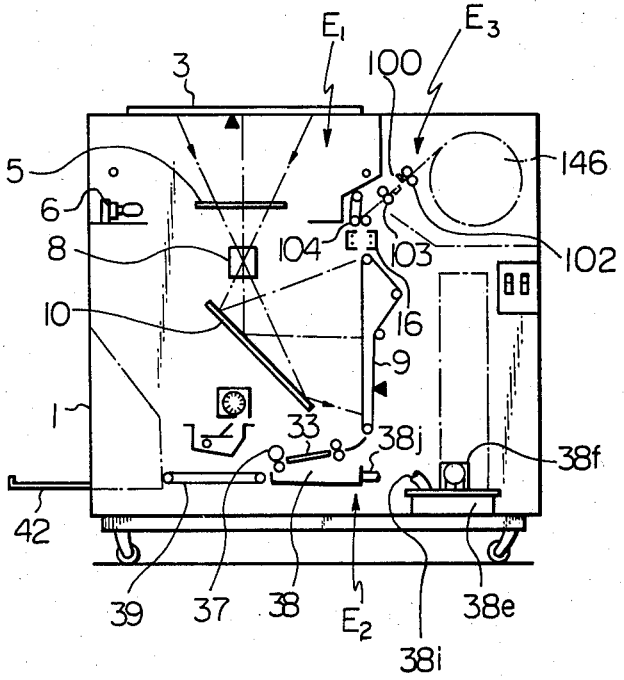
FIG. 9 is a schematic vertical sectional view of another copying machine according to the present invention, in which the black frame eliminating mechanism and random cutting mechanism are incorporated.

The above-mentioned random cutting assembly incorporated in the copying machine is able to prepare sheets of the photosensitive paper in various lengths as required from the photosensitive roll paper. Therefore, if such cutting assembly is incorporated into the conventional copying machine, the copying machine produces copied papers on which defective black frames are formed, when sheets of paper having lengths longer than that of the original are cut according to necessity. Such disadvantage can be avoided by a copying machine in which the black frame eliminating mechanism and cutting assembly of the present invention are incorporated. A preferred embodiment of such advantageous copying machine is indicated in FIG. 9. In FIG. 9, $E_1$ denotes a black frame eliminating mechanism comprising the elements corresponding to those of the black frame eliminating mechanism indicated in FIG. 2. The corresponding elements in FIG. 9 are assigned the same reference numbers as those in FIGS. 2 and 8. The developing and fixing assembly indicated by $E_2$ in FIG. 9 is also indicated in detail in FIG. 8. A cutting assembly $E_3$ in FIG. 9 corresponds to that indicated in FIG. 6, and the corresponding elements in FIG. 9 are assigned the same reference numbers as those in FIG. 6.

Figure 10:
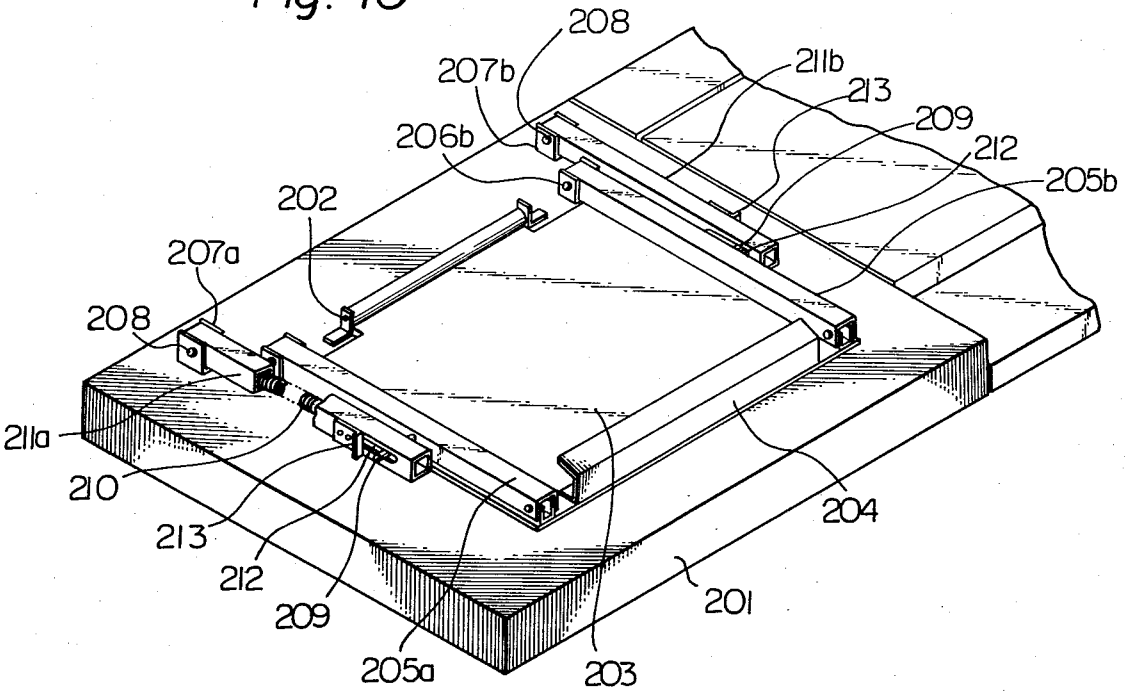
FIG. 10 is a perspective view of the original depressing plate means of the present invention.
Figure 11:
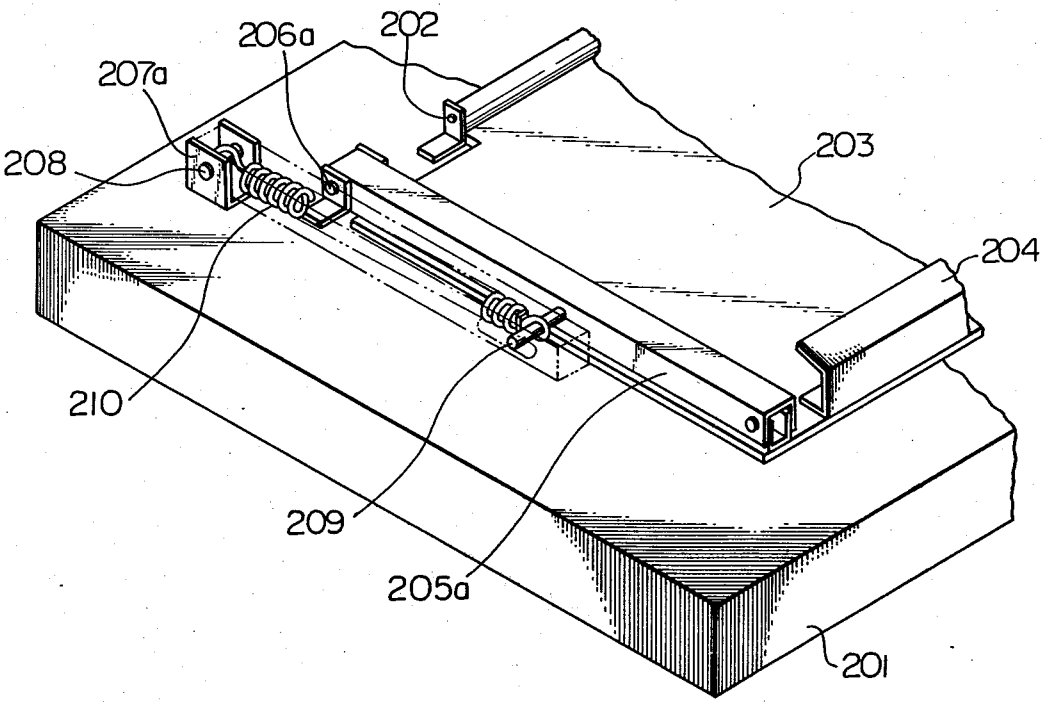
FIG. 11 is an enlarged perspective and partially cut-off view of the depressing plate means as shown in FIG. 10.

The present invention further includes an improved original depressing plate means incorporated in a copying machine, which depressing plate means is indicated in FIGS. 10 and 11 and corresponds to the original depressing plate 3 indicated in FIGS. 1, 2 and 9.

Referring to FIG. 10, reference number 201 denotes an original table which forms a portion of the upper surface of the machine housing. The original table has at its central area, a window for supporting an original, which window corresponds to the original supporting window 2 indicated in FIG. 2. On the original table 201, an original depressing plate 203 of an elastic rubber is disposed, one lateral side of plate 203 is pivoted to the table 201 by a pivot 202.

The depressing plate 203 is positioned so that it covers the original supporting window (not shown) in the table 201. A grip 204, which can be grasped with the operator's fingers is fixed to the other lateral side of the original depressing plate 203 located opposite to the pivot 202. One end of stays 205*a* and 205*b* for the original depressing plate 203, which extend along both lateral sides of the plate 203 adjacent to the sides thereof supported by the pivot 202, is fixed to the plate 203. The other ends of the stays 205*a* and 205*b* are pivotably supported by pivoting members 206*a* and 206*b*, respectively, which are positioned on a line extending from the pivot 202. A pair of pivoting members 207*a* and 207*b* disposed behind the pivot 202 is secured to the above-mentioned original table 201. A tension spring 210 is provided between an axis 208 of each of the pivoting members 207*a* and 207*b*, and a pin 209 provided at the intermediate portion of each of the stays 205*a* and 205*b*. In the embodiment shown in the drawings, covers 211*a* and 211*b* in the form of a rectangular tube for covering the tension springs 210 are provided in order to protect the operator's clothes from being caught by the springs 10 during operation of the original depressing plate 3. Ends of the covers 211*a* and 211*b* are pivotably supported onto the above-mentioned axes 208, as shown in FIG. 11. The pins 209 are inserted through elongated holes or slots 212 located near to the other ends of the covers 211*a* and 211*b*. A stopper 213 for stopping each of the pins 209 is fixed to a side of each of the covers 211*a* and 211*b*. The movement of force exerted onto the original depressing plate 203 is defined by the stoppers 213.

Figure 12:
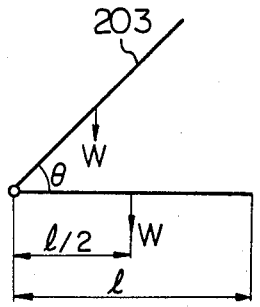
FIGS. 12 and 13 are diagrams utilized to explain the moments of force exerted onto the depressing plate means shown in FIG. 10.

The principle applied to the above-mentioned original depressing plate means will now be explained with reference to FIGS. 12 through 15. FIG. 12 is a diagram for explaining the force, i.e. moment of force, which is applied for depressing the original by the weight of the original depressing plate 203. In this case, the weight of the original depressing plate 203 can be considered to be an approximately uniform load. Accordingly, the movement of force to resulting from the weight of the original depressing plate 203 can be represented by the following equation in FIG. 14:

$$To = l/2 \cdot W \cdot \cos\theta$$

wherein l represents the length of the original depressing plate 203, W represents the weight of the original depressing plate 203, and $\theta$ represents the angle of opening of the original depressing plate 203.

Figure 13:
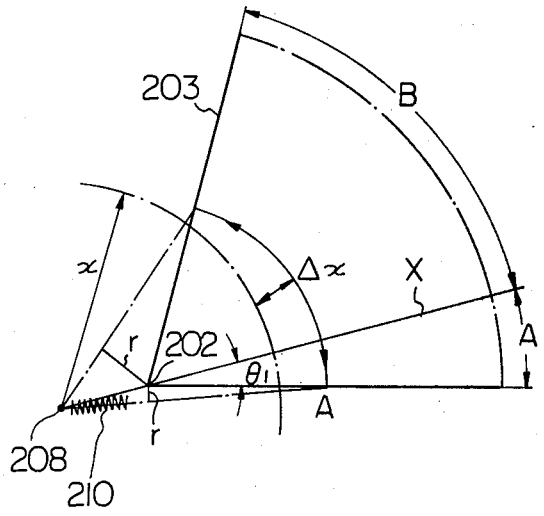
Figure 14:
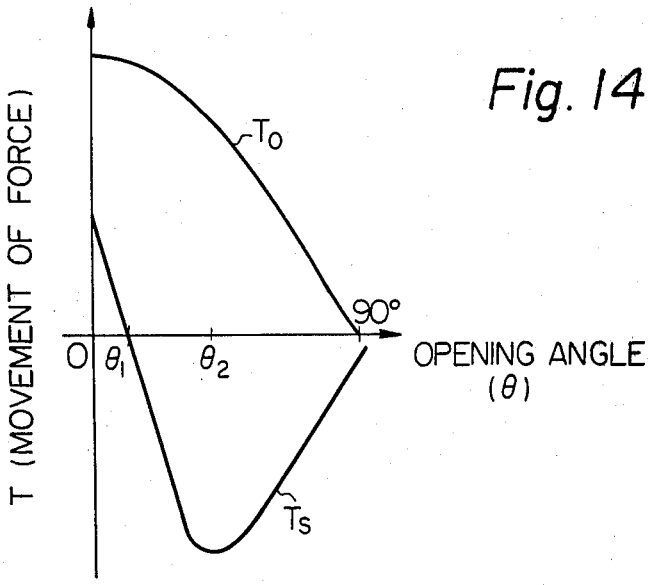
FIGS. 14 and 15 are diagrams showing variations in the moments of force in accordance with the opening angle of the depressing plate means relative to the original supporting window.

On the other hand, as shown in FIG. 13, the moment of force Ts applied to the original depressing plate 3 by the tension springs 210 is effected in a clockwise direction in the zone A positioned below the straight line X which extends from a position of the pivot 22 to a position of the axis 208. These positions are situated on a vertical plane to which the pivot 202 and the axis 208 are perpendicular. The moment of force Ts is also effected in a counterclockwise direction in the zone B above the straight line X. However, the moment of force Ts is "dead" or motionless on the line X. The moment of force Ts can be represented by the following equation:

$$Ts = Ts_1 + Ts_2 + 2Ts_1 = 2F \cdot r = 2K \cdot \Delta x \cdot r$$

wherein F represents the tension of the tension spring 210, r represents the minimum spacing or length of the tension spring 210 from the pivot 202, h represents the spring constant of the tension spring 210, and $\Delta x$ represents an elongation of the tension spring 210.

In FIG. 13, x designates a free length of the tension spring 10, and $\theta_1$ indicates an angle between the straight line X and a horizontal plane. Accordingly, when the results are plotted on the graph of FIG. 14, the moment of force applied to the original depressing plate 203 by the tension spring 210 is represented by the curved line Ts.

Figure 15:
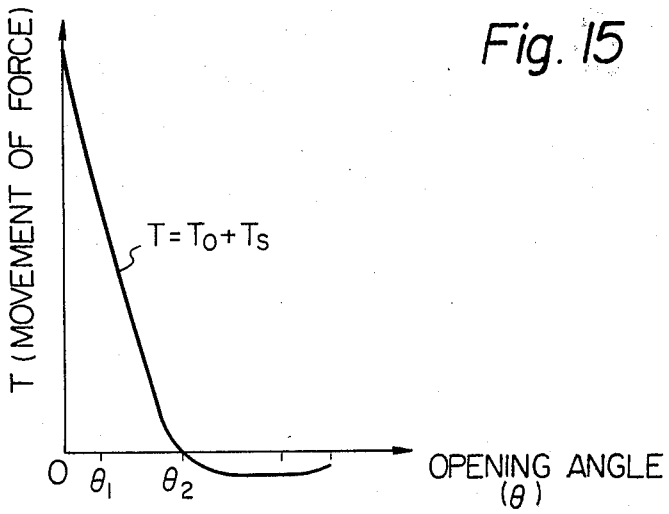

FIG. 15 shows the moment of force curve T which is obtained by taking into consideration both the weight of the original depressing plate 203 and the tension springs 210. That is, the moment curve T is obtained by adding the moment of force To caused by the weight of the original depressing plate 203 to the moment of force Ts by the tension springs 10. As will be apparent from FIG. 15, the moment of force T which occurs when $\theta$ is equal to zero, that is, when the original depressing plate 203 depresses the original, is by far larger than that occurring when the weight of the original depressing plate 203 is imposed on the original. Accordingly, even if the original is a voluminous binded book or the like, incomplete focusing and the curve of an image due to the spacing apart of a portion of the original from the original supporting window can be prevented. Further, when the angle $\theta$ of the opening $\theta_2$ of the original depressing plate 203 is larger than $\theta_1$, the moment of force T becomes zero. When the aforesaid angle exceeds $\theta_2$, the moment of force T is reversed in a counterclockwise direction. This means that the original depressing plate 203 is automatically opened or turned up at an angle exceeding a predetermined value. The depressing plate means is advantageous in that if the pin 9 is stopped by the stopper 13 at an angle $\theta$ in the following range: $\theta_2 < \theta \leqq 90°$, for example, at an angle of 70°, the operator can easily operate the original depressing plate 203 with a hand.

As will be understood from the explanation given hereinbefore, in the original depressing plate means, since the depressing force of the original depressing plate can be increased, a high-quality copy having no unclear images due to the incomplete focusing and the curve of the image can be obtained. In addition, in the original depressing plate means, the original depressing plate is automatically opened at an angle of opening thereof exceeding a predetermined value. Consequently, the original depressing device can be operated smoothly. The original depressing plate means has further advantages in that it has a simple construction, causes no trouble and can be manufactured at a low cost.

The present invention includes a further improved conveying assembly incorporated in a copying machine and used preferably for feeding a developed paper out of the machine housing while the paper is being dried and fixed. An embodiment of the assembly is indicated in FIGS. 16 and 17, and corresponds to an assembly denoted by "$E_4$" in FIG. 2.

Figure 16:
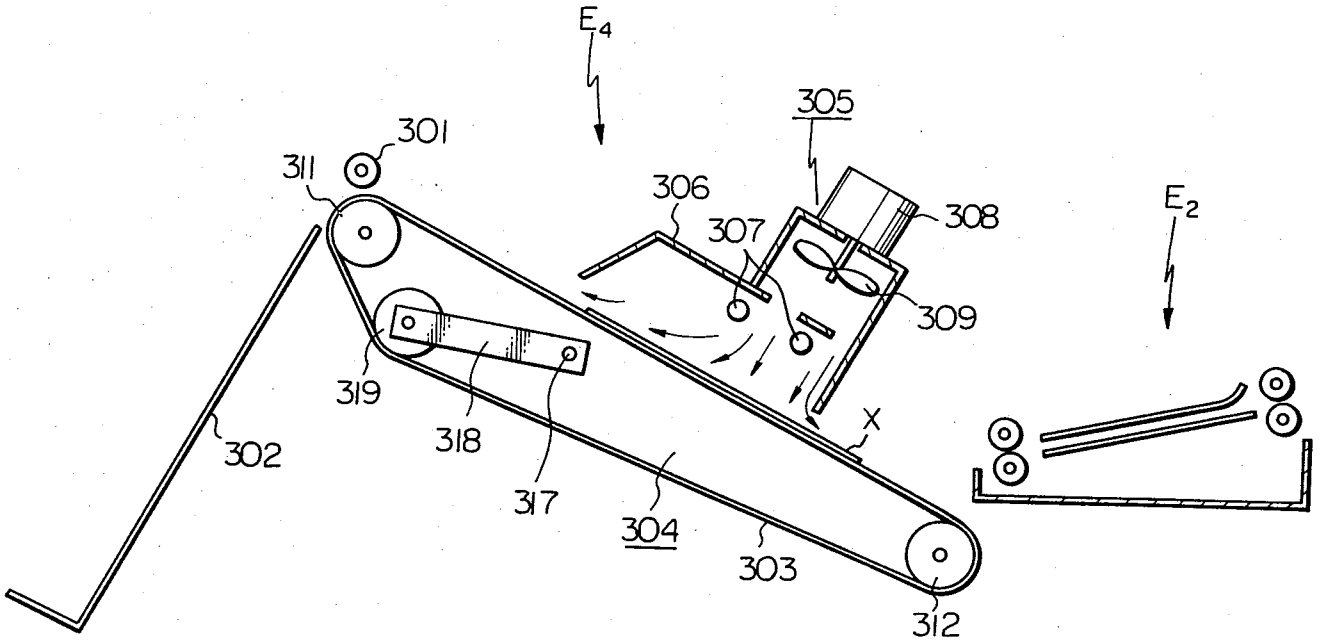
FIG. 16 is a diagrammatic view of the paper conveying assembly according to the present invention, used for conveying developed papers while they are being fixed and dried.
Figure 17:
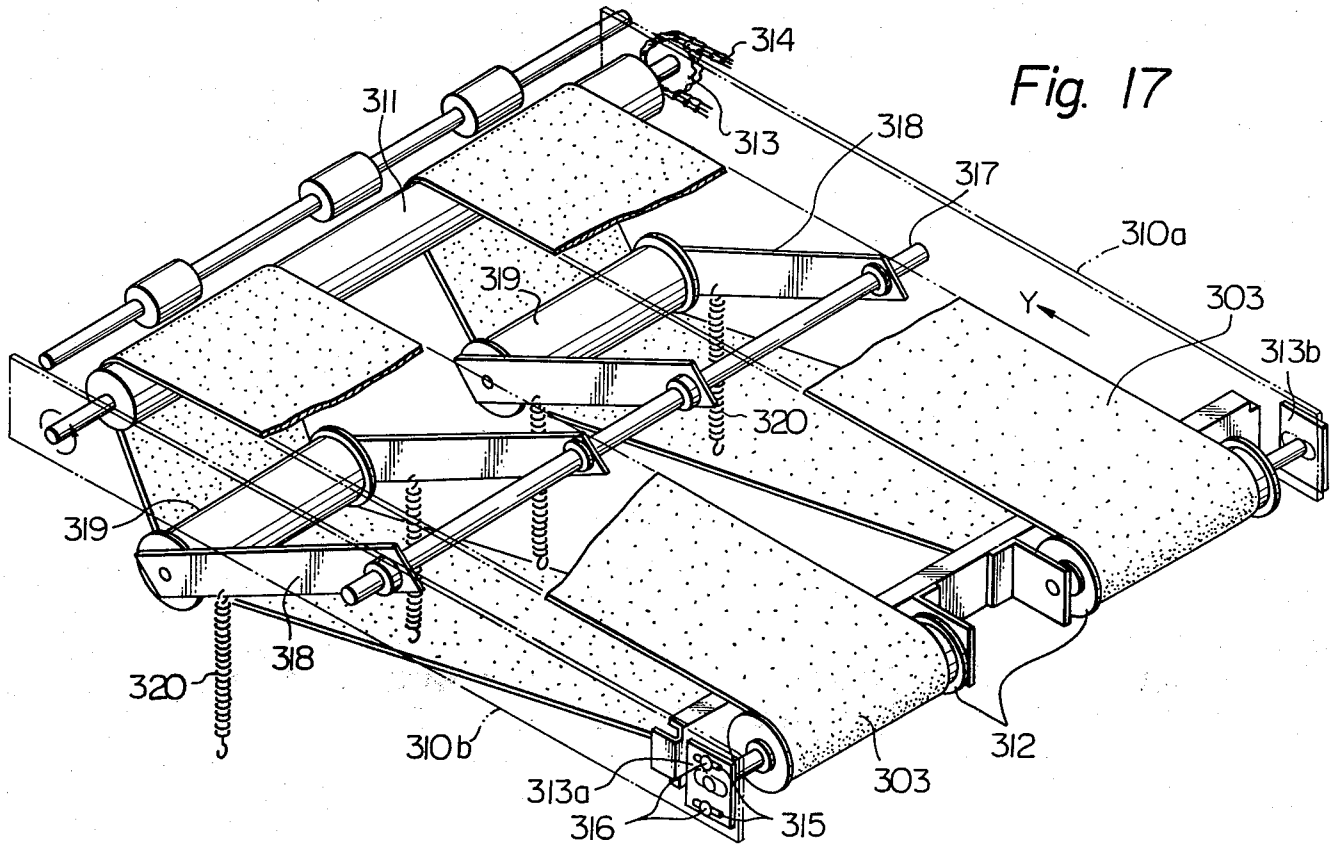
FIG. 17 is an enlarged perspective and partially cut-off view of the conveyor shown in FIG. 16.

Referring to FIG. 16, a conveying assembly $E_4$ is positioned adjacent to a developing assembly $E_2$. A paper copy X developed in the developing assembly is fixed and dried while being transported or conveyed upwardly. The paper copy X is then discharged to a shooter 302 positioned at a discharging opening, by means of a delivery roller 301.

The conveying assembly comprises a conveyer 304 provided with endless belts 303 for conveying the paper copy X thereon, and a compressed air injection device 305, i.e., a hot air drier located over and arranged along upper surfaces of said endless belts 303 for blowing a compressed air flow against a surface of the paper copy X. The compressed air injection device 305 is provided with an injection casing 306 opened toward the upper surfaces of the belts 303. In the injection casing 306, an infrared ray heater 307 and a blower 309 driven by a motor 308 are installed. Accordingly, a compressed air flow is blown from the injection casing 306 against the surface of the paper copy X placed on the belts 303. The paper copy X is depressed onto the surfaces of the belts 303 by the compressed air. Each of the endless belts 303 is prepared so as to impart a proper friction to the surface of the paper copy X to be conveyed. As shown in detail in FIG. 17, the conveying assembly is arranged so as to pass around a driving roller 311 and each of the following rollers 312, both extending between a pair of frames 310*a* and 310*b*. As a result of experiments, the present inventors have found that abrasive belts of No. 16 through 400 in accordance with JIS R6254, used in an electrically driven belter for trimming workpieces are suitable as the endless belts 303. The abrasive belts, prepared by applying abrasives onto the surfaces of basic materials, are advantageous in that they exhibit a high coefficient of friction and an increased tensile strength and are available at a low cost.

Furthermore, a driving chain 314 is provided which passes around a sprocket wheel 313 of the driving roller 311. The belts 303 are driven by the driving chain 314 in the direction indicated by the arrow Y in FIG. 17. On the other hand, an end of each of the following rollers 312 is supported by each bearing plates 313*a* and 313*b*, which are fixed adjustably to the frames 310*a* and 313, respectively. More particularly, the bearing plates 313*a* and 313*b* are fixed to the frames 310*a* and 310*b* by means of screws 316, which are driven into the frames 310*a* and 310*b* through elongated holes 315 in the bearing plates 313*a* and 313*b*. Accordingly, the belts 303 can be prevented from moving in a slack state by adjusting the positions at which the bearing plates 313*a* and 313*b* are arranged on the frames 310*a* and 310*b*. A supporting shaft 317 is provided between the driving roller 311 and the following rollers 312 so that the shaft 307 extends parallel to the rollers 311 and 312. Tension roller 319, around which the belts 303 pass, are supported by arms 318. Each of the arms 318 in turn is tiltably supported at its end by the supporting shaft 317. Tension springs 320 are provided at intermediate portions of the respective arms 318. The belts 303 are kept in a tensioned state by means of the springs 320.

As will be apparent from the explanation given hereinbefore, the belts 303 have a sufficient friction coefficient for firmly holding the paper copies thereon, and also the paper copies are depressed onto the surfaces of the belts 303 by the compressed air inejected from the compressed air injection device 305. Therefore, the paper copies can be surely transported, even if the conveyer 304 has a steep slope. Furthermore, when the present conveying assembly is applied to the electrophotographic copying machine or the like, the hot air drier may be utilized as the compressed air injection device 305. Accordingly, the conveying assembly can be manufactured at a by far lower cost and with a more simplified construction, as compared with the conventional device. The conveying assembly has further advantages due to its durable structure and easy maintenance.

What is claimed is:

1. An electrophotographic copying machine comprising:

housing means;

means for supporting an original to be copied comprising a transparent window disposed at the upper surface of the housing means, the transparent window being so constructed that its length is longer than the length of originals of various sizes to be copied;

original depressing plate means constructed and disposed to cover the transparent window and having a white undersurface facing the entire surface of said window;

means for positioning a sheet of photosensitive paper in a predetermined stationary position with its surface disposed at substantially a right angle to the surface of the transparent window;

means for feeding sheets of photosensitive paper one by one to the positioning means;

exposure means disposed in the housing means comprising a source of light constructed and disposed to illuminate the entire surface of the transparent window, and optical means constructed and disposed to expose the paper in said predetermined stationary position to the light image from the entire surface of the transparent window, said optical means comprising a projection lens and a reflective mirror disposed in that order along the optical passage so that the lens projects the light image to the paper via said mirror with the leading edge of the positioned paper substantially registered with the forward end of the light image projected from the original;

charging means for depositing an electrostatic charge on the surface of the paper while the paper is fed to the positioning means;

and control means for controlling the charging means to deposit the charge over a fixed length of the paper beginning with its leading edge and less than its total length, said fixed length being at least as long as the projected light image corresponding to the longest original to be copied, but shorter than the projected light image corresponding to the window;

whereby a first portion of the paper is exposed to the light image projected from the original, while a second portion of the paper adjacent the first paper portion is exposed to the light image projected from the marginal white surface portion of the depressing plate means adjacent said original, thereby preventing the formation of a black frame on the paper.

2. The electrophotographic copying machine according to claim 1, wherein the photosensitive paper positioning means comprises a plurality of rollers, at least one endless belt having a plurality of suction ports and encircling said rollers, and suction means disposed in said endless belt, said positioning means adapted to cause the paper to be adhered to the belt surface and being disposed in said housing so that the surface of the adhered paper is at said substantially right angle to the surface of the supporting means.

3. The electrophotographic copying machine according to claim 2, wherein the photosensitive paper feeding means comprises means for driving the rollers of the paper positioning means, and means for controlling the drive to said rollers so that the paper is stopped on the surface of the belt at said predetermined stationary position.

4. An electrophotographic copying machine according to claim 1, further comprising an original supporting table forming a portion of the upper surface of said housing, said table including said transparent window located at the central area of said table, said original depressing plate means comprising:

a depressing plate;

first, second and third pivoting means having first, second and third pivot axes respectively, and;

spring members, a lateral side end of said plate being pivoted to said table by said first pivoting means, the ends of said spring members being pivoted to said table by said second pivoting means, said second pivotal axis being parallel to said first and third pivotal axes and positioned outside of said lateral side end of said plate, the other ends of said spring members being respectively pivoted to intermediate portions of two opposite side ends of said plate by said third pivoting means, said opposite side ends being perpendicular to said lateral side end, wherein:

a first position of said first pivotal axis is deviated from a second position of said second pivotal axis on a plane perpendicular to said first, second and third pivotal axes;

a straight line on said plane, extending from said second position and passing through said first position, is inclined upwardly to a plane parallel to the surface of said supporting means, and;

said spring members are in stretched states when said plate covers said supporting means.

5. An electrophotographic copying machine according to one of claims 1 through 3, further comprising a developing assembly where the exposed paper is developed and a conveying assembly for conveying the developed paper while the paper is dried, said conveying assembly comprising:

conveying means which includes endless belts being inclined and moved in a tensioned condition in a predetermined direction, said endless belts exhibiting friction of a proper coefficient against the paper to be held and conveyed on said belts;

compressed air injection means for blowing compressed air against the surface of the paper from above said conveying means, and;

a heater adapted to heat the air to be fed into said compressed air injection means.

6. An electrophotographic copying machine according to claim 1, further comprising another source of light in said housing adapted to illuminate said supporting window when said depressing plate means is turned up from said supporting window, thereby to enable an operator to ascertain the position of pattern of the original relative to said supporting window.

7. An electrophotographic copying machine according to claim 1, further comprising a wet developing apparatus including means for squeezing the developing liquid contained in a developed paper therefrom, said squeezing means comprising a squeezing roller and a driving roller between which the developed paper passes, said squeezing roller being adapted to be disengageable from said driving roller and engageable with said driving roller by manual operations from only one side of said housing.

8. A electrophotographic copying machine according to claim 6, further comprising a wet developing apparatus including means for squeezing the developing liquid contained in a developed paper therefrom, said squeezing means comprising a squeezing roller and a driving roller between which the developed paper passes, said squeezing roller being adapted to be disengageable from said driving roller and engageable with said driving roller by manual operations from only one side of said housing.

9. A electrophotographic copying machine according to claim 7, wherein said squeezing means comprises:

a pair of side plate members having pivots respectively;

a pair of levers pivoted to said side plate members by said corresponding pivots, respectively;

said squeezing roller rotatably mounted to the ends of said levers;

a pair of spring means connected to the other ends of said levers, respectively, and adapted to cause said squeezing roller to depress said driving roller, and;

a pair of eccentric cam means rotatably mounted to said side plate members and adapted to urge the portion of said levers between said other ends of said levers and said pivots, respectively, so that said squeezing roller is disengaged from said driving roller in accordance with the eccentricity of said cam means.

10. An electrophotographic copying machine according to claim 9, further comprising a pair of frame members having said driving roller rotatably mounted thereto and at least one guide rail member secured thereto, and fixed to the machine, said side plate members having at least a slide rail member secured thereto, said slide rail being slidable along and engagable with said guide rail member.

11. An electrophotographic copying machine according to claim 1, wherein said feeding means for photosensitive papers comprises:

a roll of paper suspended for rotating freely;

roller means for feeding said roll of paper comprising first rollers disposed downstream of said roll of paper, second rollers disposed on the feeding-out side of said first rollers and third rollers disposed on the feeding-out side of said second rollers;

means for cutting the portion of said roll of paper between said first and second rollers;

first means for driving said first and second rollers so that they rotate synchronously, said first driving means including first clutch means for transmitting the drive to said first and second rollers and cutting off said transmission of the drive, and second clutch means permitting said second roller to rotate only so as to feed the leading end of the roll paper towards said third rollers;

second means for driving said third rollers, and;

braking means for stopping the movement of said roll paper at the position of said first rollers or at a position upstream of said first rollers, wherein while said third rollers continues to rotate by said second driving means, said first clutch means is cut off and said braking means is actuated so that at least the portion of said roll of paper between said first and second rollers is stationary and is tensioned, said cutting means is actuated so as to cut said stationary and tensioned portion of said roll of paper.

12. An electrophotographic copying machine according to claim 11, wherein said second driving means transmits the drive to said third rollers so that said third rollers feed said roll of paper in a downstream direction at the feed velocity lower than that of said second rollers in order to cause the portion of said roll of paper between said second and third rollers to be slack, said cutting means being actuated so that the cutting operation is completed while said slack is maintained or being changed to a tensioned condition.

13. An electrophotographic copying machine according to claim 11, wherein said braking means is adapted to prevent said first rollers from rotating freely when said first clutch means is cut off.

14. An electrophotographic copying machine according to claim 11, wherein said braking means is located at a position upstream of said first rollers and is adapted to prevent said roll of paper from rotating freely when said first clutch means is cut off.

15. An electrophotographic copying machine according to claim 11, further comprising means for operating said cutting means in correspondence with the feeding amount of said roll of paper, and means for setting a length of a sheet of paper to be cut, said operating means comprising means for driving said cutting means, switch means adapted to energize said driving means for said cutting means, cam means adapted to actuate said switch means, and means for driving said cam means including one-revolution clutch means adapted to normally prevent said cam means from rotating and permit said cam means to rotate for one revolution when said one-revolution clutch is cut off, said length setting means comprising a scale board with a dial indicating the length to be set and means for setting the initial phase angle of said cam means relative to said switch means in correspondence with the length indicated on said scale board by said dial.

16. An electrophotographic copying machine according to claim 14, wherein said depressing plate has staying members pivoted to said table by said first pivoting means, said staying members forming said third pivoting means.

17. An electrophotographic copying machine according to claim 4, further comprising casings for accommodating said spring members, said casings being pivoted to said table by said second pivoting means and having slots through which said third pivoting means extend outwardly and along which said third pivoting means is movable one ends of said slots forming stopping means for stopping the rotation of said depressing plate about said first pivotal axis.

18. An electrophotographic copying machine according to one of claims 6 through 10, wherein said feeding means for photosensitive papers comprises:

a roll of paper suspended for rotating freely;

roller means for feeding said roll of paper comprising first rollers disposed downstream of said roll of paper, second rollers disposed on the feeding-out side of said first rollers and third rollers disposed on the feeding-out side of said second rollers;

means for cutting the portion of said roll of paper between said first and second rollers;

first means for driving said first and second rollers so that they rotate synchronously, said first driving means including first clutch means for transmitting the drive to said first and second rollers and cutting off said transmission of the drive, and second clutch means permitting said second roller to rotate only so as to feed the leading end of the roll paper toward said third rollers;

second means for driving said third rollers, and;

braking means for stopping the movement of said roll paper at the position of said first rollers or at a position upstream of said first rollers, wherein while said third rollers continues to rotate by said second driving means, said first clutch means is cut off and said braking means is actuated so that at least the portion of said roll of paper between said first and second rollers is stationary and is tensioned, said cutting means is actuated so as to cut said stationary and tensioned portion of said roll of paper.

19. An electrophotographic copying machine according to one of claims 11 through 15, further comprising means for operating said cutting means in correspondence with the feeding amount of said roll of paper, and means for setting a length of a sheet of paper to be cut, said operating means comprising means for driving said cutting means, switch means adapted to energize said driving means for said cutting means, cam means adapted to actuate said switch means, and means for driving said cam means including one-revolution clutch means adapted to normally prevent said cam means for rotating and permit said cam means to rotate for one revolution when said one-revolution clutch is cut off, said length setting means comprising a scale board with a dial indicating the length to be set and means for setting the initial phase angle of said cam means relative to said switch means in correspondence with the length indicated on said scale board by said dial.

20. A paper cutting assembly incorporated in an electrophotographic copying machine, comprising:

a roll of paper suspended for rotating freely;

roller means for feeding said roll of paper comprising first rollers disposed downstream of said roll of paper, second rollers disposed on the feeding-out side of said first rollers, and third rollers disposed on the feeding-out side of said second rollers;

means for cutting the portion of said roll of paper between said first and second rollers;

first means for driving said first and second rollers so as to rotate synchronously, said first driving means including first clutch means for transmitting the drive to said first and second rollers and cutting off said transmission of the drive and second clutch means permitting said second roller to rotate only so as to feed the leading end of the roll paper toward said third rollers;

second means for driving said third rollers;

braking means for stopping the movement of said roll paper at the position of said first rollers or at a position upstream of said first rollers;

wherein, while said third rollers continues to rotate by said second driving means, said first clutch means is cut off and said braking means is actuated so that at least the portions of said roll of paper between said first and second rollers is stationary and is tensioned, and said cutting means is actuated so as to cut said stationary and tensioned portion of said roll of paper.

21. A paper cutting assembly according to claim 20, wherein said second driving means transmits the drive to said third rollers so that said third rollers feed said roll of paper in a downstream direction at the feed velocity lower than that of said second rollers in order to cause the portion of said roll of paper between said second and third rollers to be slack, said cutting means being actuated so that the cutting operation is completed while said slack is maintained or being changed to a tensioned condition.

22. A paper cutting assembly according to claim 20, wherein said braking means is adapted to prevent said first rollers from rotating freely when said first clutch means is cut off.

23. A paper cutting assembly according to claim 20, wherein said braking means is located at a position upstream of said first rollers and is adapted to prevent said roll of paper from rotating freely when said first clutch means is cut off.

24. A paper cutting assembly according to one of claims 20 through 23, further comprising means for operating said cutting means in correspondence with the feeding amount of said roll of paper, and means for setting a length of a sheet of paper to be cut, said operating means comprising means for driving said cutting means; switch means adapted to energizing said driving means for said cutting means; cam means adapted to actuate said switch means; and means for driving said cam means including one-revolution clutch means adapted to normally prevent said cam means from rotating and permit said cam means to rotate for one revolution when said one-revolution clutch is cut off, said length setting means comprising a scale board with a dial indicating the length to be set and means for setting the initial phase angle of said cam means relative to said switch means in correspondence with the length indicated on said scale board by said dial.

25. A wet developing apparatus incorporated in an electrophotographic copying machine, comprising means for squeezing the developing liquid contained in a developed paper therefrom, said squeezing means comprising a squeezing roller and a driving roller between which the developed paper passes, and means operably connected to said squeezing roller to cause said squeezing roller to be disengaged from said driving roller and to be engaged with said driving roller by manual operations from only one side of the machine housing.

26. A wet developing apparatus incorporated in an electrophotographic copying machine, comprising means for squeezing the developing liquid contained in a developed paper therefrom, said squeezing means comprising:

a pair of side plate members having pivots respectively;

a pair of levers pivoted to said side plate members by said corresponding pivots, respectively;

a squeezing roller and a driving roller between which the developed paper passes, said squeezing roller being rotatably mounted to the ends of said levers, and adapted to be disengageable from said driving roller and engageable with said driving roller by manual operations from only one side of the machine housing;

a pair of spring means connected to the other ends of said levers, respectively, and adapted to cause said squeezing roller to depress said driving roller, and;

a pair of eccentric cam means rotatably mounted to said side plate members and adapted to urge the portion of said levers between said other ends of said levers and said pivots, respectively, so that said squeezing roller is disengaged from said driving roller in accordance with the eccentricity of said cams.

27. A wet developing apparatus according to claim 26, further comprising a pair of frame members having said driving roller rotatably mounted thereto and at least one guide rail member secured thereto, and fixed to the machine, said side plate members having at least a slide rail member secured thereto, said slide rail being slidable along and engageable with said guide rail member.

28. An original depressing plate assembly incorporated in an electrographic copying machine comprising an original supporting table forming a portion of the upper surface of a housing of the machine, said table including an original supporting means of the transparent window located at the central area of said table and an original depressing plate means which comprising:

a depressing plate;

first, second and third pivoting means having first, second and third pivoted axes respectively, and;

spring members, a lateral side end of said plate being pivoted to said table by said first pivoting means, the one ends of said spring members being pivoted to said table by said second pivoting means, said second pivotal axis being parallel to said first and third pivotal axes and positioned outside of said lateral side end of said plate, the other ends of said spring members being pivoted respectively to intermediate portions of two opposite side ends of said plate by said third pivoting means, said opposite side ends being perpendicular to said lateral side end, wherein:

a first position of said first pivotal axis is deviated from a second position of said second pivotal axis on a plane perpendicular to said first, second and third pivotal axes;

a straight line, on said plane, extending from said second position and passing through said first position is inclined upwardly to a plane parallel to the surface of said supporting means, and;

said spring members are in stretched states when said plate covers said supporting means.

29. An original depressing plate assembly according to claim 28, wherein said depressing plate has staying members pivoted to said table by said first pivoting means, said staying members forming said third pivoting means.

30. An original depressing plate assembly according to one of claims 28 and 29, further comprising casings for accommodating said spring members, said casings being pivoted to said table by said second pivoting means and having slots through which said third pivoting means extend outwardly and along which said third pivoting means is movable, ends of said slots forming stopping means for stopping rotation of said depressing plate about said first pivotal axis.

* * * * *

UNITED STATES PATENT AND TRADEMARK OFFICE

CERTIFICATE OF CORRECTION

PATENT NO. : 4,239,371

DATED : December 16, 1980

INVENTOR(S) : Yousuke Igarashi et al.

It is certified that error appears in the above-identified patent and that said Letters Patent are hereby corrected as shown below:

Column 19, line 43, change "to" to --To--.

Column 23, line 37, "claims 1 through 3" should be changed to read --claims 1 through 3 and 6 through 17--.

Column 25, line 37, change the numeral "14" to the numeral --4--.

Signed and Sealed this

*Nineteenth* Day of *May 1981*

[SEAL]

*Attest:*

RENE D. TEGTMEYER

*Attesting Officer*

*Acting Commissioner of Patents and Trademarks*